US010674803B2

(12) United States Patent
Kosoglow et al.

(10) Patent No.: US 10,674,803 B2
(45) **Date of Patent: *Jun. 9, 2020**

(54) WEARABLE BAND INCLUDING MAGNETS

(71) Applicant: Apple Inc., Cupertino, CA (US)

(72) Inventors: Richard D. Kosoglow, San Jose, CA (US); Hao Zhu, San Jose, CA (US); James A. Stryker, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/166,005

(22) Filed: Oct. 19, 2018

(65) Prior Publication Data

US 2019/0053610 A1 Feb. 21, 2019

Related U.S. Application Data

(63) Continuation of application No. 14/643,643, filed on Mar. 10, 2015, now Pat. No. 10,123,608.

(60) Provisional application No. 62/035,912, filed on Aug. 11, 2014.

(51) Int. Cl.
*A45F 5/00* (2006.01)
*A44C 5/20* (2006.01)

(52) U.S. Cl.
CPC ..... *A45F 5/00* (2013.01); *A44C 5/2071* (2013.01); *A44D 2203/00* (2013.01); *A45F 2005/008* (2013.01); *A45F 2200/0508* (2013.01)

(58) Field of Classification Search
CPC ..... A45F 5/00; A45F 2005/008; A45F 2200/0508; A44C 5/2071; A44D 2203/00
USPC ..... 224/267
See application file for complete search history.

(56) References Cited

U.S. PATENT DOCUMENTS 3,579,159 A * 5/1971 Posey ..... H01H 36/004 335/205
3,815,066 A * 6/1974 Vinal ..... H03K 17/90 335/306
3,873,957 A * 3/1975 Wurscher ..... H03K 17/90 338/32 H
3,906,417 A * 9/1975 Serras-Paulet ..... H01H 13/52 335/205
3,938,642 A * 2/1976 Van Rumpt ..... B41J 5/26 400/480
4,054,944 A * 10/1977 Lau ..... H01H 5/02 335/207
4,280,214 A * 7/1981 Kunii ..... G04B 37/22 368/281

(Continued)

FOREIGN PATENT DOCUMENTS

CN 2497586 7/2002
CN 1395896 2/2003

(Continued)

*Primary Examiner* — Peter N Helvey
(74) *Attorney, Agent, or Firm* — Morgan, Lewis & Bockius LLP (Apple)

(57) ABSTRACT

A wearable band may include a first strap portion including a loop, and a second strap portion positionable through the loop of the first strap portion. The second strap portion may include a multi-pole magnet assembly, the multi-pole magnet assembly including two or more magnets arranged in a multi-pole magnet structure and at least one discrete shunt positioned over a surface of the multi-pole magnet structure.

20 Claims, 19 Drawing Sheets

(56) References Cited

U.S. PATENT DOCUMENTS 4,453,148 A * 6/1984 Norakidze ..... H01H 36/004 335/205
4,868,530 A * 9/1989 Ahs ..... G05G 5/05 335/207
4,941,236 A * 7/1990 Sherman ..... A44C 5/2071 24/265 WS
5,076,623 A * 12/1991 Richards ..... E05B 47/0038 292/144
5,323,516 A * 6/1994 Hartmann ..... A44C 5/2071 24/303
5,349,725 A * 9/1994 Levy ..... A44C 5/2009 24/303
5,367,891 A * 11/1994 Furuyama ..... A44C 5/2057 24/303
5,682,653 A * 11/1997 Berglof ..... G09F 1/10 24/303
5,889,737 A * 3/1999 Alameh ..... G04C 10/00 368/204
5,977,888 A * 11/1999 Fujita ..... H01H 13/705 341/34
6,050,931 A * 4/2000 Russell ..... A61N 2/06 600/15
6,301,754 B1 * 10/2001 Grunberger ..... A41F 1/002 24/303
6,598,271 B2 * 7/2003 Nire ..... A41F 1/002 24/265 WS
6,598,272 B2 * 7/2003 Nire ..... A41F 1/002 24/265 WS
7,043,740 B2 * 5/2006 Chen ..... G11B 17/051 720/610
7,151,282 B2 * 12/2006 Lambkin ..... H01L 33/105 257/79
7,152,282 B2 12/2006 Costa et al.
7,308,737 B2 * 12/2007 Saitoh ..... E05B 47/0038 24/303
7,496,994 B1 * 3/2009 Headley ..... A44C 5/2019 24/303
7,667,623 B2 * 2/2010 Soh ..... G06F 3/0202 200/5 A
7,708,456 B2 * 5/2010 Kraus ..... A44C 5/14 24/265 WS
8,467,270 B2 * 6/2013 Gossweiler, III ..... G04G 17/06 345/173
8,505,334 B2 * 8/2013 Niikura ..... A44C 15/005 224/172
8,704,626 B2 * 4/2014 Fullerton ..... H01F 7/0247 335/285
8,717,132 B2 * 5/2014 Lancaster-Larocque ..... G06F 1/1616 335/207
8,937,520 B2 * 1/2015 Kan ..... H01H 36/00 335/205
8,957,751 B2 * 2/2015 Fullerton ..... H05K 9/00 335/296
8,978,213 B2 * 3/2015 Hayton ..... A44B 11/06 24/303
8,985,410 B2 * 3/2015 Wishart ..... A44C 5/0007 224/183
8,994,827 B2 * 3/2015 Mistry ..... G06F 3/0304 348/158
8,997,318 B2 * 4/2015 Nicolas ..... A44C 5/04 24/265 WS
9,089,193 B2 * 7/2015 Casini ..... A44C 5/2071
9,141,086 B1 * 9/2015 Rohrbach ..... G04B 37/1486
9,333,641 B2 * 5/2016 Macias ..... B25H 3/00
9,404,776 B2 * 8/2016 Fullerton ..... H01F 7/021
9,826,789 B2 * 11/2017 Dey ..... A41D 20/00
2002/0104151 A1 * 8/2002 Rauscher ..... A41F 9/002 2/338
2003/0229974 A1 * 12/2003 Zemer ..... A44C 5/2076 24/303
2005/0102802 A1 * 5/2005 Sitbon ..... A41F 1/002 24/303
2006/0257190 A1 * 11/2006 Chiang ..... B41J 5/12 400/474
2008/0256979 A1 * 10/2008 Okamura ..... A44C 5/2071 63/3.1
2009/0289090 A1 * 11/2009 Fullerton ..... A45F 5/02 224/183
2011/0048069 A1 * 3/2011 Komatsu ..... A44C 5/0023 63/1.11
2013/0326790 A1 * 12/2013 Cauwels ..... A44C 5/2071 2/170
2014/0000312 A1 * 1/2014 Nicolas ..... A44C 5/04 63/3.2
2014/0033482 A1 * 2/2014 Fullerton ..... H01F 7/02 24/303
2014/0077910 A1 * 3/2014 Chaizy ..... H01F 7/0242 335/295
2016/0037875 A1 * 2/2016 Rohrbach ..... G04B 37/1486 224/267
2016/0037879 A1 * 2/2016 Qian ..... A44B 11/258 24/3.2
2016/0037896 A1 * 2/2016 Kosoglow ..... A45F 5/00 224/267
2016/0037897 A1 * 2/2016 Bataillou ..... A44C 5/20 224/267
2016/0042897 A1 * 2/2016 Qian ..... H01H 13/85 335/207

FOREIGN PATENT DOCUMENTS

| | | |
|---|---|---|
| CN | 1794931 | 6/2006 |
| CN | 101657120 | 2/2010 |
| CN | 201440767 | 4/2010 |
| CN | 102481034 | 5/2012 |
| CN | 203314250 | 12/2013 |
| CN | 103504731 | 1/2014 |
| CN | 203469237 | 3/2014 |
| CN | 204838302 | 12/2015 |
| EP | 1980170 | 10/2008 |
| JP | H 10-165211 | 6/1998 |
| JP | 2011-078524 | 4/2011 |
| WO | WO 2013/090198 | 6/2013 |
| WO | WO 03/056956 | 7/2013 |

* cited by examiner

WEARABLE BAND INCLUDING MAGNETS

CROSS-REFERENCE TO RELATED APPLICATION

This application is a continuation of U.S. patent application Ser. No. 14/643,643, filed Mar. 10, 2015, which claims the benefit to U.S. Provisional Patent Application No. 62/035,912, filed Aug. 11, 2014 and titled "Wearable Band Including Magnets," the disclosures of which are hereby incorporated herein by reference in their entireties.

TECHNICAL FIELD

The disclosure relates generally to electronic devices, and more particularly to a wearable band for an electronic device.

BACKGROUND

Conventional wearable electronic devices include bands that couple the electronic device to a user or a desired object for holding the electronic device (e.g., bicycle handlebar).

For example, a conventional wristwatch typically includes a band that attaches the watch to a user's wrist. There are many varieties of conventional wearable bands for watches including, but not limited to, elastic bands, flexible bands including buckles, and metal bands including metal clasps. However, each of these conventional bands may have negative aspects, and may undesirably fail prior to the failure of the wearable electronic device.

For example, a conventional elastic band may lose its elastic properties over time, and may become too big for a user's wrist, which may result in the electronic device unexpectedly slipping from a user's wrist and being damaged. In another example, the material forming the flexible bands may tear or deteriorate over time due to normal and/or the concentrated force applied at the hole of the flexible band by the tongue of the buckle. The metal bands including the metal clasp may include a plurality of components all coupled together, which may fail, become uncoupled, or otherwise malfunction over time. That is, the plurality of components forming the metal band may become damaged, not function properly over time, or may become uncoupled, rendering the metal band incapable of attaching the wearable electronic device to a user. When a conventional wearable band fails and/or is incapable of securely attaching the electronic device to a user's wrist, the band needs to be replaced and/or the wearable electronic device may be susceptible to damage.

SUMMARY

Generally, embodiments discussed herein are related to a wearable band for an electronic device. The wearable band may include two strap portions coupled to a wearable electronic device. The first strap portion may include a loop and the second strap portion, capable of being inserted through the loop of the first strap portion, may include a plurality of components having magnetic properties (e.g., magnets, ferrous metals). The wearable electronic device including the wearable band may be secured to an object (e.g., user's wrist) by inserting the second strap portion through the loop of the first strap portion and releasably coupling the components of the second strap portion to one another. More specifically, a group of one or more magnets positioned at a first end of the second strap portion may be magnetically coupled to a distinct group of one or more magnets positioned at a second end, opposite the first end, after the second end is positioned through the loop of the first strap portion and folded back on the remainder of the second strap portion. At least one of the magnets in the first group and/or in the second group may be configured as a multi-pole magnet assembly that includes two or more magnets arranged in a multi-pole magnet structure and at least one discrete shunt positioned over a surface of the multi-pole magnet structure.

In one aspect, a wearable band may include a first strap portion including a loop, and a second strap portion positionable through the loop of the first strap portion. The second strap portion may include one or more magnets positioned adjacent a first end of the second strap portion, and one or more magnets positioned adjacent a second end, opposite the first end, of the second strap portion. At least one of the magnets may be configured as a multi-pole magnet assembly that includes two or more magnets arranged in a multi-pole magnet structure and at least one discrete shunt positioned over a surface of the multi-pole magnet structure.

In another aspect, a wearable electronic device may include a housing and a wearable band coupled to the housing. The wearable band may include a first strap portion including a loop coupled to a first portion of the housing, and a second strap portion coupled to a second portion, opposite the first portion, of the housing. The second strap portion may include a first group of one or more magnets positioned adjacent a first end of the second strap portion and a second group of one or more magnets positioned adjacent a second end of the second strapbportion. The second group of one or more magnets may be positioned opposite the first group of one or more magnets. At least one magnet in the first group and/or the second group may be configured as a multi-pole magnet assembly that includes two or more magnets arranged in a multi-pole magnet structure and at least one discrete shunt positioned over a surface of the multi-pole magnet structure.

In another aspect, the wearable band may include a strap and a multi-pole magnet assembly within the strap. The multi-pole magnet assembly includes two or more magnets arranged in a multi-pole magnet structure and at least one discrete shunt positioned over a surface of the multi-pole magnet structure.

BRIEF DESCRIPTION OF THE DRAWINGS

Embodiments of the invention are better understood with reference to the following drawings. The elements of the drawings are not necessarily to scale relative to each other. Identical reference numerals have been used, where possible, to designate identical features that are common to the figures.

DETAILED DESCRIPTION

Reference will now be made in detail to representative embodiments illustrated in the accompanying drawings. It should be understood that the following descriptions are not intended to limit the embodiments to one preferred embodiment. To the contrary, they are intended to cover alternatives, modifications, and equivalents as can be included within the spirit and scope of the described embodiments as defined by the appended claims.

Embodiments of a wearable band may include two strap portions coupled to a wearable electronic device. The first strap portion may include a loop and the second strap portion, capable of being inserted through the loop of the first strap portion, may include a plurality of components having magnetic properties (e.g., magnets, ferrous metals). The wearable electronic device including the wearable band may be secured to an object (e.g., user's wrist) by inserting the second strap portion through the loop of the first strap portion and releasably coupling the components of the second strap portion to one another. More specifically, one or more magnet assemblies positioned at a first end of the second strap portion may be magnetically coupled to one or more magnet assemblies positioned at a second end, opposite the first end, after the second end is positioned through the loop of the first strap portion and folded back on the remainder of the second strap portion. By utilizing magnets, the magnetic bond or coupling formed between the plurality of components in the second strap portion may not substantially weaken or fail over time, as may occur with other securing mechanisms such as traditional buckles. Additionally, as a result of the components being included in and/or encased within the second strap portion, the risk of mechanical failure (e.g., loss or damage of components) may be substantially minimized.

These and other embodiments are discussed below with reference to FIGS. 1-23. However, those skilled in the art will readily appreciate that the detailed description given herein with respect to these Figures is for explanatory purposes only and should not be construed as limiting.

Figure 1:
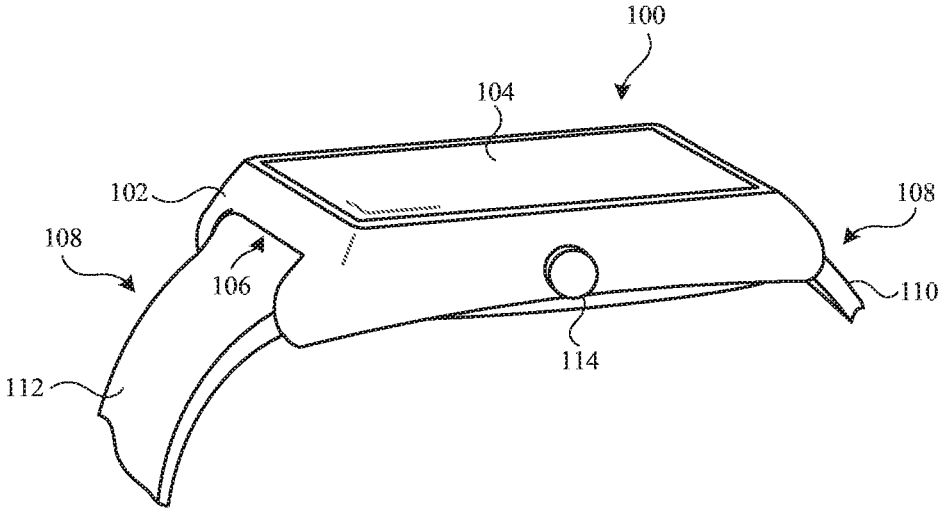
FIG. 1 depicts an illustrative perspective view of one example of a wearable electronic device.

Referring now to FIG. 1, there is shown an illustrative perspective view of one example of a wearable electronic device 100. Wearable electronic device 100, as shown in FIG. 1, may be configured to provide health-related information or data such as but not limited heart rate data, blood pressure data, temperature data, oxygen level data, diet/nutrition information, medical reminders, health-related tips or information, or other health-related data. The wearable electronic device may optionally convey the health-related information to a separate electronic device such as a tablet computing device, phone, personal digital assistant, computer, and so on. In addition, wearable electronic device 100 may provide additional information, such as but not limited to, time, date, health, statuses of externally connected or communicating devices and/or software executing on such devices, messages, video, operating commands, and so forth (and may receive any of the foregoing from an external device), in addition to communications.

Wearable electronic device 100 may include a housing 102 at least partially surrounding a display 104 and one or more buttons 114 or input devices. The housing 102 may form an outer surface or partial outer surface and protective case for the internal components of wearable electronic device 100, and may at least partially surround the display 104.

Housing 102 may also include recesses 106 formed on opposite ends to connect a wearable band 108 (partially shown in FIG. 1) to wearable electronic device 100. As shown in FIG. 1, and discussed herein, wearable band 108 may include a first strap portion 110 coupled to housing 102, and a second strap portion 112 positioned opposite first strap portion 110 and coupled to housing 102. Wearable band 108, and specifically first strap portion 110 and second strap portion 112, may be used to secure wearable electronic device 100 to a user, or any other object capable of receiving wearable electronic device 100. In a non-limiting example where wearable electronic device 100 includes a smart watch, wearable band 108 may secure the watch to a user's wrist. In other non-limiting examples, wearable electronic device 100 may secure to or within another part of a user's body. Additionally, in other non-limiting examples discussed herein, wearable band 108 may be formed as a single component coupled to housing 102.

Display 104 may be implemented with any suitable technology, including, but not limited to, a multi-touch sensing touchscreen that uses liquid crystal display (LCD) technology, light emitting diode (LED) technology, organic light-emitting display (OLED) technology, organic electroluminescence (OEL) technology, or another type of display technology.

Button 114 may include any conventional input/output (I/O) device for electronic device 100. Specifically, button 114 may include an actuation component in electronic and/or mechanical communication with the internal components of electronic device 100, to provide user input and/or allow the user to interact with the various functions of electronic device
100. In an embodiment, button 114 may be configured as a single component surrounded by housing 102. Alternatively, button 114 may include a plurality of components, including an actuation component, in mechanical/electrical communication with one another and/or internal components of electronic device 100.

Figure 2:
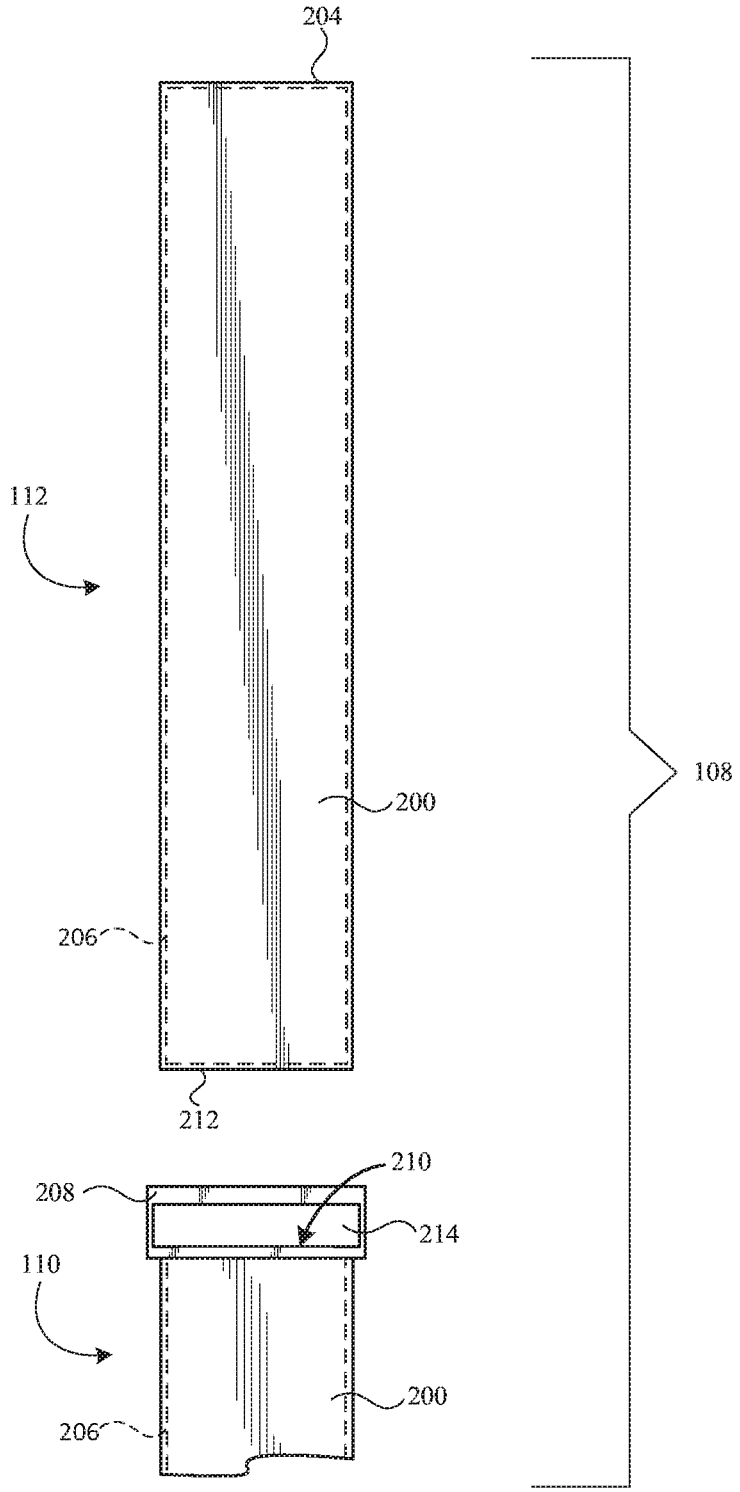
FIG. 2 shows an illustrative top view of the wearable band as shown in FIG. 1.

FIG. 2 shows an illustrative top view of wearable band 108 of FIG. 1. Specifically, FIG. 2 shows first strap portion 110 and second strap portion 112 forming wearable band 108 for wearable electronic device 100. First strap portion 110 and second strap portion 112 may be formed from substantially the same material or any material including similar flexible and/or deformable characteristics. In a non-limiting example, first strap portion 110 and second strap portion 112 may be formed from a leather material.

First strap portion 110 and second strap portion 112 may be formed from a top layer 200 and a bottom layer 202 (see, FIG. 4) of material (e.g., leather) bonded or coupled to one another. More specifically, first strap portion 110 and second strap portion 112 may be formed using a single piece of material or multiple pieces of material, where first strap portion 110 and second strap portion 112 include top layer 200 and bottom layer 202. In a non-limiting example, each of first strap portion 110 and second strap portion 112 may be formed from single, distinct pieces of material. In the non-limiting example, the single piece of material may be folded over itself to form top layer 200 and bottom layer 202, and the folded portion may be positioned at a housing end 204 (e.g., second strap portion 112). Housing end 204 of first strap portion 110 (not shown) and/or second strap portion 112 may be coupled to and/or positioned within recess 106 (see, FIG. 1) to couple wearable band 108, and specifically first strap portion 110 and second strap portion 112, to housing 102 of wearable electronic device 100 (see, FIG. 1). In another non-limiting example, first strap portion 110 and second strap portion 112 may be formed from multiple pieces of material, where each distinct piece of material forms top layer 200 or bottom layer 202 for first strap portion 110 and/or second strap portion 112. In an additional non-limiting example discussed herein, wearable band 108 may be formed from a single piece of material that, such that first strap portion 110 and second strap portion 112 are integrally formed.

First strap portion 110 and second strap portion 112 may include a coupling component 206 (shown in phantom) positioned substantially around and/or adjacent the perimeter of the respective strap. Coupling component 206 may include a suitable material or technique that may be used to couple top layer 200 and bottom layer 202 to one another to form first strap portion 110 and/or second strap portion 112. Additionally, and as discussed herein, coupling component 206 may be utilized within first strap portion 110 and/or second strap portion 112 to ensure internal components of the respective straps remain within and/or between top layer 200 and bottom layer 202. In a non-limiting example, and as discussed herein, coupling component 206 may include an adhesive or bonding agent positioned adjacent the perimeter of first strap portion 110 and/or second strap portion 112 to bond top layer 200 to bottom layer 202. In another non-limiting example, coupling component 206 may include a thread that may pass through top layer 200 and bottom layer 202 around the perimeter of first strap portion 110 and/or second strap portion 112 to couple top layer 200 to bottom layer 202.

As shown in FIG. 2, first strap portion 110 may include a loop 208 positioned at an end 210 adjacent second strap portion 112. As discussed herein, a free end 212 of second strap portion 112 may be fed and/or positioned through opening 214 of loop 208, and a portion of second strap portion 112 may fold back on itself to couple wearable electronic device 100 (see, FIG. 1) to a user or a desired object. In a non-limiting example, loop 208 may be formed from a distinct material or component that may be coupled to the material forming first strap portion 110 (see, FIG. 2). More specifically, as shown in FIG. 2, loop 208 may be a distinct component from first strap portion 110, and may be formed from a material having magnetic properties. For example, loop 208 may be formed from a ferrous metal material, and may be coupled to end 210 of first strap portion 110 using any suitable coupling component and/or technique (e.g., thread, adhesive, melting and so on). As discussed herein, loop 208 of first strap portion 110 may be formed from a material having magnetic properties to prevent free end 212 of second strap portion 112 from being completely and/or undesirably removed from loop 208 during use of wearable electronic device 100 (see, FIG. 1).

Figure 3:
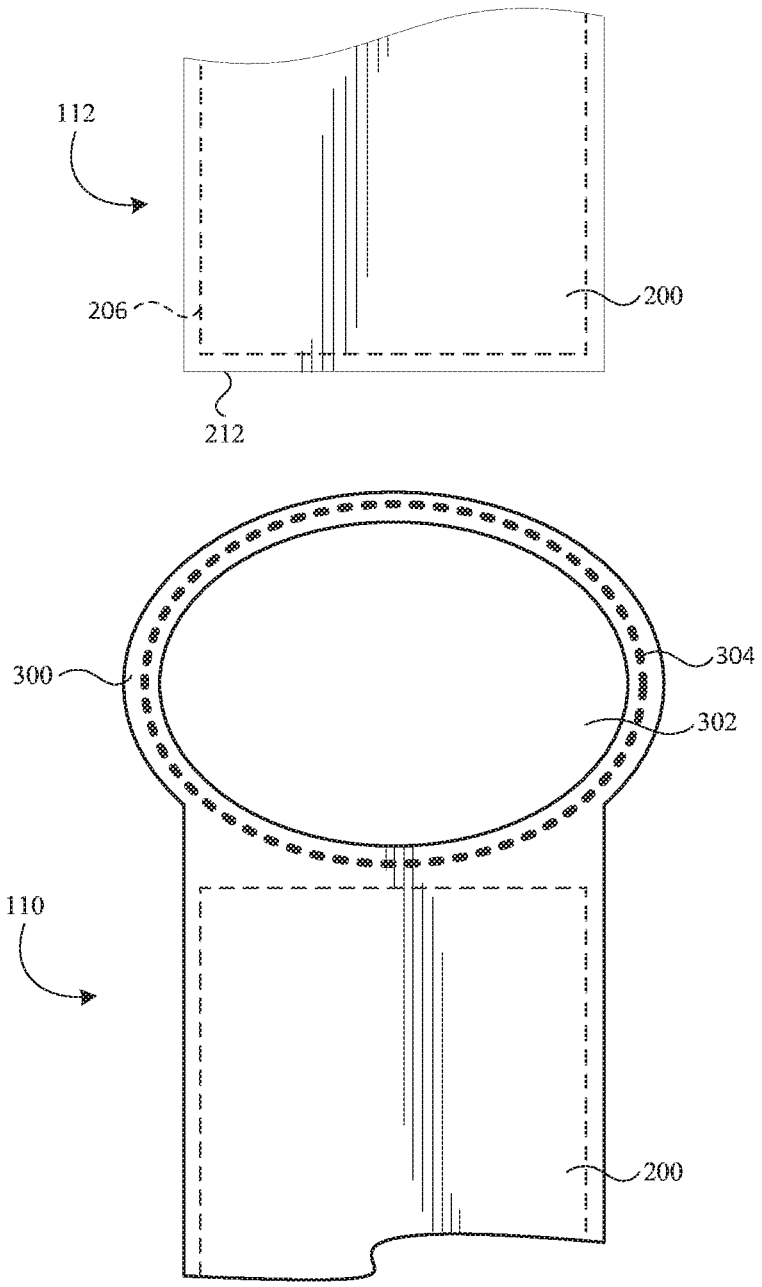
FIG. 3 depicts an enlarged top view of a portion of a first strap portion and a second strap portion of the wearable band as shown in FIG. 2.

In another non-limiting example, as shown in FIG. 3, loop 300 may be formed integrally with first strap portion 110. More specifically, loop 300 may be formed from the same material forming first strap portion 110, and may include top layer 200 and bottom layer 202 (see, FIG. 4), as similarly discussed herein with respect to first strap portion 110. As shown in FIG. 3, opening 302 of loop 300 may be formed through the material forming loop 300 and/or first strap portion 110 and may receive free end 212 of second strap portion 112.

Figure 4A:
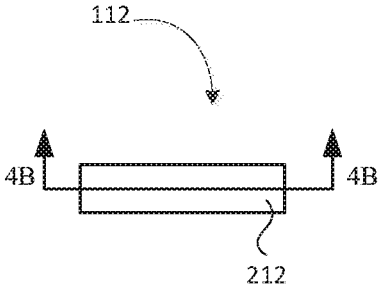
FIG. 4A shows an illustrative end view of the second strap portion of the wearable band.
Figure 4B:
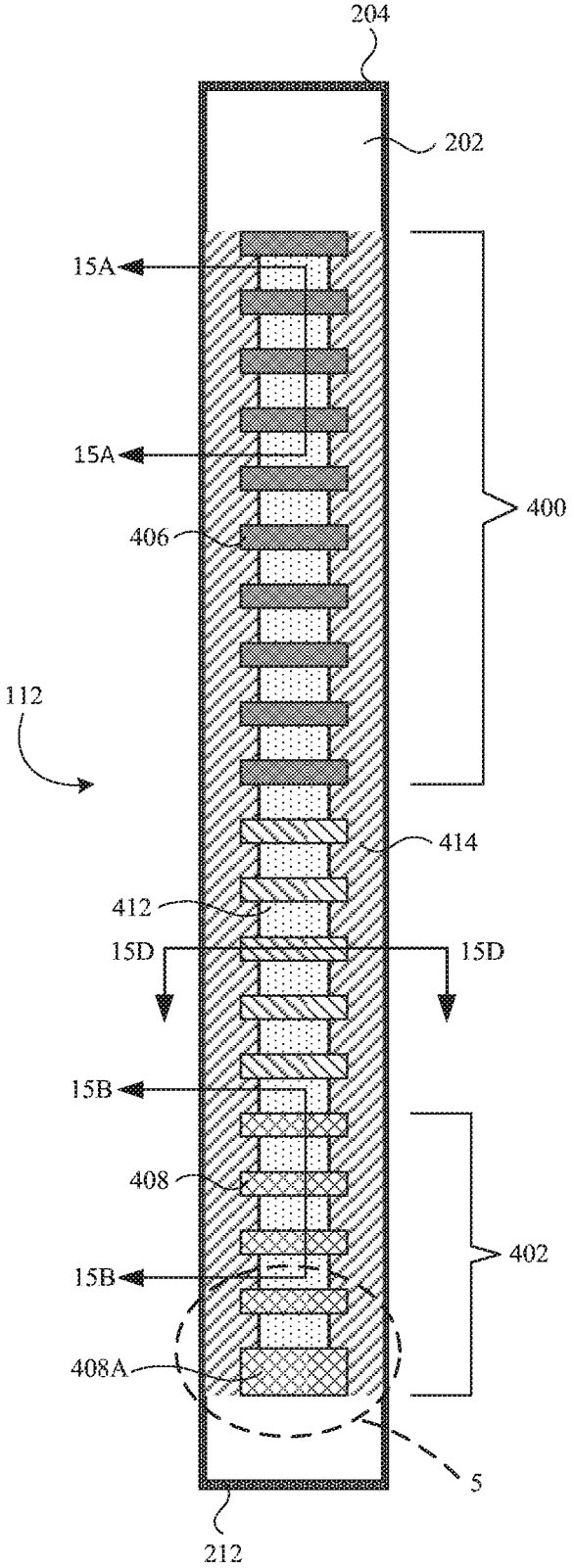
FIG. 4B shows a cross-section top view of a strap of the wearable band taken along line 4B-4B in FIG. 4A.

Referring now to FIG. 4B, there is shown a cross-section top view of second strap portion 112 of wearable band 108 taken along line 4B-4B of FIG. 4A (which shows an end view of second strap portion 112). Specifically, FIG. 4B shows second strap portion 112 with top layer 200 removed. As shown in FIG. 4, and as discussed herein with respect to FIG. 2, coupling component 206 may be positioned substantially around and/or substantially adjacent a perimeter of second strap portion 112. Coupling component 206 may include an adhesive or bonding agent that may positioned on bottom layer 202 of second strap portion 112, and may couple or bond bottom layer 202 to top layer 200 (see, FIG. 2) to form second strap portion 112. The adhesive or bonding agent forming coupling component 206 may be any suitable adhesive capable of coupling the material forming top layer 200 and bottom layer 202 of second strap portion 112.

Second strap portion 112 may include a plurality of components 400, 402 and inserts 404. More specifically, as shown in FIG. 4, second strap portion 112 may include a first group of components 400 positioned adjacent housing end 204, and a second group of components 402 positioned adjacent free end 212, opposite first group of component 400. Second strap portion 112 may also include one or more inserts 404 positioned between first group of component 400 and second group of components 402. The first group of components 400, the second group of components 402, and the plurality of inserts 404 may be positioned within second strap portion 112 between top layer 200 and bottom layer 202.

The first group of components 400, the second group of components 402, and the plurality of inserts 404 may all include magnetic properties. That is, each of the components 400, 402 and inserts 404 may all be formed from a material that may include magnetic properties (e.g., magnetic field, magnetic attraction, and so on). In non-limiting examples, first group of components 400 may include one or more first magnets 406 having a first magnetic field, and second group of components 402 may include one or more second magnets 408 having a second magnetic field. The second magnetic field of the one or more second magnets 408 may be distinct (for example, larger) than the first magnetic field of the one or more first magnets 406. Additionally in a non-limiting example, the plurality of inserts 404 may be formed from a ferrous metal material and may be magnetically attracted to the one or more second magnets 408. As discussed in detail below, the one or more second magnets 408 of the second group of components 402 may be magnetically attracted and/or coupled to the one or more first magnets 406 of the first group of components 400 and/or the one or more inserts 404 for coupling wearable band 108 including wearable electronic device 100 to a user.

First magnets 406 and/or second magnets 408 may be single magnets or multi-pole magnetic structures. For example, in some embodiments, first magnets 406 and/or second magnets 408 are composed of a single monolithic magnet. In other embodiments, first magnets 406 and/or second magnets 408 are composed of multiple individual magnets. Where the magnets 406, 408 are composed of multiple individual magnets, respective magnets may be coupled to adjacent magnets via magnetic attraction, adhesive, soldering, cementing, welding, sintering, or the like. In some cases, the individual magnets that constitute first or second magnets 406, 408 are not coupled to one another, but are merely in proximity to one another in an assembled band 108. Examples of multi-pole magnet structures and embodiments of wearable bands 108 that employ multi-pole magnet structures are discussed herein.

As shown in FIG. 4B, the number of first magnets 406 in first group of components 400 may be larger than the number of second magnets 408 in second group of components 402 and/or the number of inserts 404. As a result, the one or more first magnets 406 in first group of components 400 may be positioned along the majority of a length of second strap portion 112. In a non-limiting example, as shown in FIG. 4, the one or more first magnets 406 in first group of components 400 may be positioned along approximately half of the length of second strap portion 112. The one or more second magnets 408 in second group of components 402 and the one or more inserts 404 may span or be positioned over the remainder of the length of second strap portion 112. Specifically, second magnet(s) 408 in second group of components 402 may be positioned over at least approximately a quarter of the length of second strap portion 112. Additionally, the one or more inserts 404 may be positioned over the remaining portion of second strap portion 112 between first group of components 400 and second group of components 402.

It is understood that the number of components 400, 402 or magnets 406, 408 and inserts 404 shown in FIG. 4B may be merely exemplary. That is, the number of components, magnets and/or inserts shown in FIG. 4B may be merely exemplary for clearly and completely describing the disclosure, and may not represent the actual number of components, magnets and/or inserts used to form wearable band 108 for wearable electronic device 100 (see, FIG. 1).

As shown in FIG. 4B, the one or more second magnets 408 of second group of components 402 may include an enlarged second magnet 408A positioned directly adjacent free end 212 of second strap portion 112. Enlarged second magnet 408A may be substantially larger than the remaining second magnets 408 of second group of components 402. Additionally, enlarged second magnet 408A may be substantially larger than the remaining one or more first magnets 406 of first group of components 400, and/or the one or more inserts 404. Enlarged second magnet 408A may be larger than the remaining second magnets 408 of second group of components 402 to produce a stronger magnetic field or flux, and to ultimately ensure that the portion of second strap portion 112 including enlarged second magnet 408A is magnetically coupled to a distinct first magnet 406 and/or insert 404, as discussed herein.

As shown in FIG. 4B, second strap portion 112 may also include a protective layer 412. Protective layer 412 may be coupled to the various components 400, 402 and/or inserts 404 positioned within second strap portion 112. More specifically, protective layer 412 may be coupled to the one or more first magnets 406 of first group of components 400, the one or more second magnets 408 of second group of components 402, and/or the one or more inserts 404 positioned within second strap portion 112. Additionally, and as shown in FIG. 4B, protective layer 412 may be positioned between the one or more first magnets 406 of first group of components 400, the one or more second magnets 408 of second group of components 402, and/or the one or more inserts 404, respectively. Protective layer 412 may include a single layer of material, two separate layers of material, or a plurality of distinct portions of a material. In a non-limiting example, as shown in FIG. 4B, protective layer 412 may include a plurality of distinct portions of a material positioned between and coupled to each of the respective magnets 406, 408 and inserts 404 for coupling the magnets 406, 408 and inserts 404 together within second strap portion 112. In additional non-limiting examples, not shown, the respective magnets 406, 408 and inserts 404 may be coupled to a first surface of a single layer of protective layer 412, or may be coupled and/or sandwiched between two distinct layers of protective layer 412. Protective layer 412 may be formed from a polycarbonate material, and may be included within second strap portion 112 to protect magnets 406, 408 and inserts 404, to couple the respective magnets 406, 408 and inserts 404 together, and/or to maintain the shape of second strap portion 112 of wearable band 108.

Additionally, second strap portion 112 may include a filler material 414. As shown in FIG. 4, filler material 414 may substantially surround the one or more first magnets 406 of first group of components 400, the one or more second magnets 408 of second group of components 402, and/or the one or more inserts 404. Additionally, filler material 414 may substantially surround protective layer 412 of second strap portion 112. As shown in FIG. 4, filler material 414 may substantially surround magnets 406, 408, inserts 404, and/or protective layer 412, and may fill in the space between magnets 406, 408, inserts 404, and/or protective layer 412, and coupling component 206. Filler material 414 may be formed from any suitable material that may provide and/or maintain the structure of second strap portion 112 including, but not limited to, fabric, foam, rubber or the like.

Although not shown, it is understood that first strap portion 110, similar to second strap portion 112, may also include filler material 414. That is, first strap portion 110 may also include filler material 414 to substantially maintain the structure, texture, thickness and/or appearance as second strap portion 112.

Figure 5:
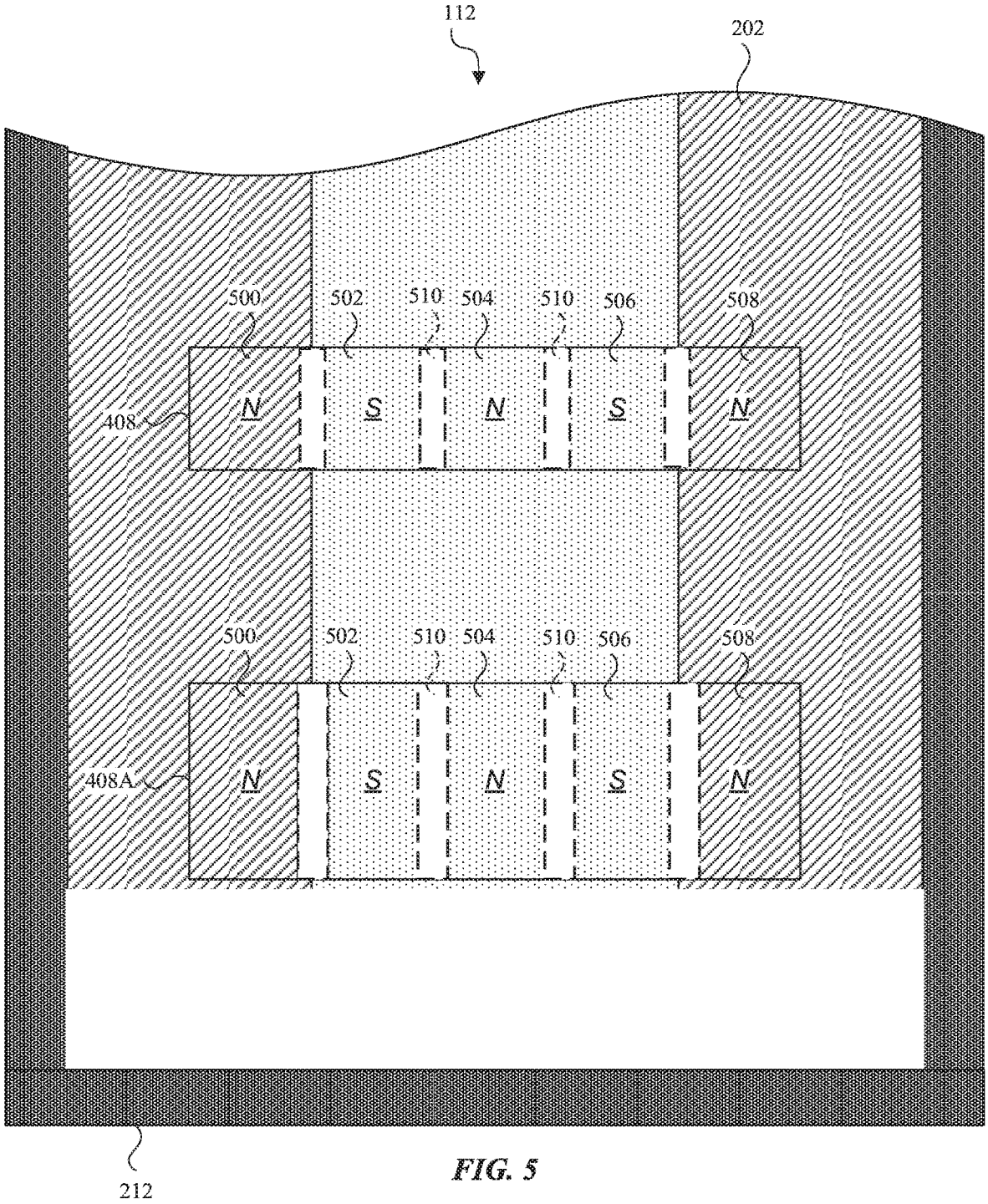
FIG. 5 depicts an enlarged top view of a second strap portion of the wearable band as shown in FIG. 4.

FIG. 5 depicts an enlarged top view of a second strap portion of the wearable band as shown in FIG. 4B. As described earlier, the one or more second magnets 408 of second group of components 402 may include an enlarged second magnet 408A positioned directly adjacent free end 212 of second strap portion 112. The enlarged second magnet 408A is configured as a multi-pole magnet structure that includes two or more magnets 500, 502, 504, 506, 508 arranged to vary the polarity pattern of the magnets. As shown in FIG. 5, the polarity pattern can be an alternating polarity pattern where the north N (positive) and south S (negative) poles alternate across the multi-pole magnet assembly.

The magnetic fields produced by the multi-pole magnet structure of the enlarged second magnet 408A may attract objects near top layer 200 and bottom layer 202 of second strap portion 112 of wearable band 108. As described with reference to FIG. 4B, the magnetic attraction force associated with top layer 200 ensures the portion of second strap portion 112 that includes enlarged second magnet 408A is magnetically coupled to a distinct first magnet 406 and/or insert 404 when the free end 212 of second strap portion 112 is positioned through a loop of first strap portion 110 and folded back on the remainder of second strap portion 112. The magnetic fields associated with bottom layer 202 (at least a portion of which is facing outward when the free end 212 of second strap portion 112 is folded back on the remainder of second strap portion 112), however, may attract or adversely impact objects located near bottom layer 202. For example, the magnetic fields can de-magnetize or otherwise interfere with credit cards, radio frequency antennas, identification badges, and the like, or attract metal objects such as paper clips, coins, and the like. Thus, in some embodiments, one or more non-contiguous or discrete shunts may be positioned over a portion of at least one surface of the multi-pole magnet structure or structures in the second strap portion 112 to re-direct the magnetic fields of the multi-pole magnet structure. As used herein, the term "multi-pole magnet assembly" includes the combination of one or more discrete shunts positioned on at least one surface of a multi-pole magnet structure.

As shown in FIG. 5, enlarged second magnet 408A includes distinct shunts 510 (shown in phantom) positioned over portions of the surface of the multi-pole magnet structure that is adjacent bottom layer 202. Distinct shunts 510 (shown in phantom) may be positioned over portions of the surface of one or more remaining multi-pole magnet structures 408 that is adjacent bottom layer 202. Shunts 510 can be made of a metal or ferromagnetic material, such as a magnetic stainless steel. Shunts 510 re-direct the magnetic fields of the multi-pole magnet structure. In some embodiments, shunts 510 dampen or reduce the peaks of the magnetic fields in the z-direction (direction normal to bottom layer 202) while not significantly reducing the magnetic fields in the x and y directions.

It is understood that a different type of multi-pole magnet structure and/or a different polarity pattern may be used in other embodiments. In a non-limiting example, a Halbach array may be used as a magnet structure, and one or more discrete shunts can be positioned on a surface or surfaces of the Halbach array (e.g., a discrete shunt can be positioned substantially near the center of the Halbach array). Additionally, the magnets in the multi-pole magnet structure and/or the discrete shunts may have any given shape and size. It is also understood that the number of magnets and/or shunts shown in FIG. 5 may be merely exemplary. That is, the number of magnets and/or shunts may be merely exemplary for clearly and completely describing the disclosure, and may not represent the actual number of magnets and/or magnets used to form wearable band 108 for wearable electronic device 100 (see, FIG. 1).

Figure 6:
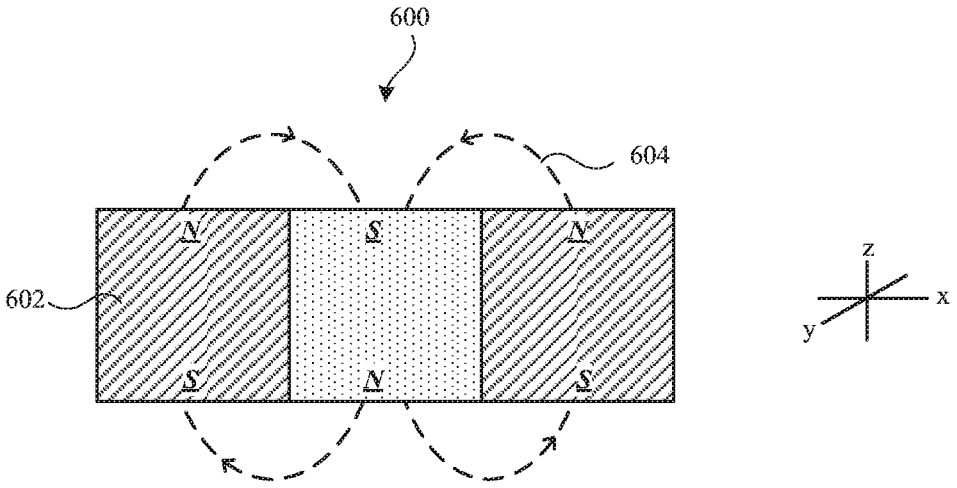
FIG. 6 shows a simplified illustration of a multi-pole magnet structure.
Figure 7:
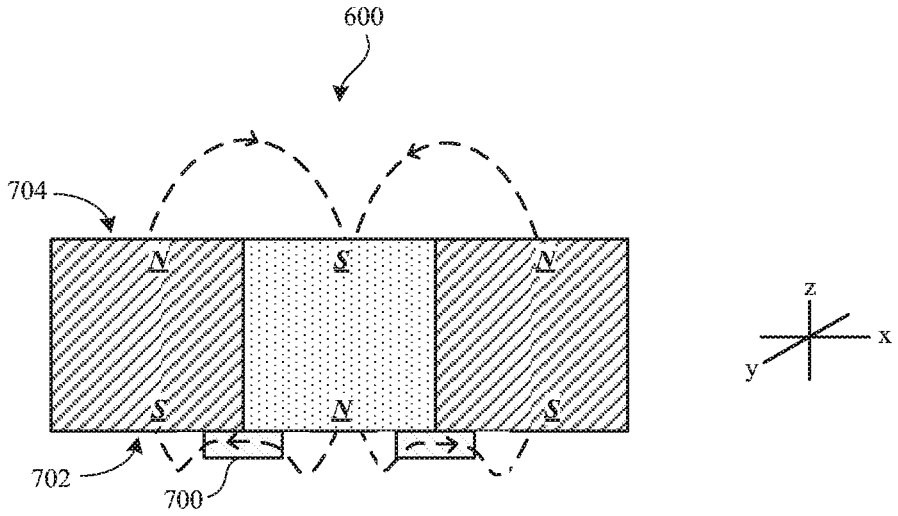
FIG. 7 depicts a simplified depiction of a first multi-pole magnet assembly.

FIG. 6 shows a simplified illustration of a multi-pole magnet structure. The multi-pole magnet structure 600 includes three magnets 602 having alternating polarities N and S. Magnetic fields or flux flow from a positive pole (e.g., N) to a negative pole (e.g., S) and from a negative pole to a positive pole in three-dimensional space around the magnets 602. In FIG. 6, magnetic field lines 604 represent the magnetic fields of the magnets 602 in only one dimension, the z direction. As shown in FIG. 7, discrete shunts 700 are positioned on surface 702 of multi-pole magnet structure 600. Shunts 700 re-direct the magnetic field through the shunts and reduce the magnetic fields emanating in the direction normal to surface 702. As shown in FIG. 7, the magnetic fields are dampened in the z-direction.

A portion of the magnetic fields from surface 702 may be directed through the magnets and out of the other surfaces of the magnets 602, which can increase the magnetic fields associated with those surfaces. Thus, the magnetic attraction forces associated with the surfaces, including surface 704, may increase due to shunts 700. Thus, in the embodiment of FIG. 5, discrete shunts 510 can dampen the magnetic attraction forces associated with bottom layer 202 and strengthen the magnetic attraction forces associated with top layer 200, which may improve the magnetic coupling between enlarged second magnet 408A (and any other second magnets 408 that include shunts) and one or more first magnets 406 and/or inserts 404.

Figure 8:
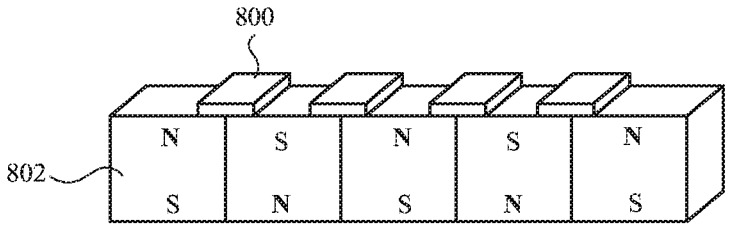
FIG. 8 shows a simplified illustration of a second multi-pole magnet assembly.
Figure 9:
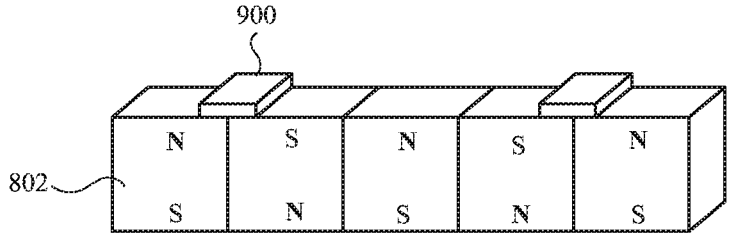
FIG. 9 depicts a simplified depiction of a third multi-pole magnet assembly.

One or more discrete shunts can be positioned at any suitable location on a multi-pole magnet structure. As shown in FIG. 8, discrete shunts 800 are positioned in a transition area between adjacent magnets 802. In other words, shunts 800 are located at adjoining or abutting edges of magnets 802. The size and/or shape of the shunts 800 can vary depending on the desired re-direction of the magnetic fields. In FIG. 8, discrete shunts 800 are positioned at each transition area between two magnets, while in FIG. 9 discrete shunts 900 are positioned at only two transition areas.

Figure 10:
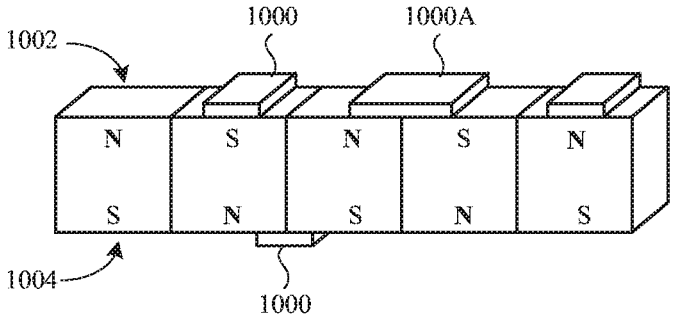
FIG. 10 shows a simplified illustration of a fourth multi-pole magnet assembly.

Additionally, one or more discrete shunts can be positioned on a single surface or on multiple surfaces of a multi-pole magnet structure. For example, as shown in FIG. 10, discrete shunts 1000 are located on surface 1002 and on an opposing surface 1004. The size and/or shape of the discrete shunts 1000 on surface 1002 may vary across a surface. As shown, discrete shunt 1000A is larger and covers more of surface 1002 than the remaining discrete shunts on surface 1002.

In some embodiments, discrete shunts can be used to produce a unique pattern of magnetic fields in one or more dimensions (e.g., x, y, and/or z directions) that may be used to identify the object or device that includes the multi-pole magnet assembly. Additionally or alternatively, the unique pattern of magnetic fields can be used to perform an operation, such as, for example, to provide access to an area, device, or application. In a non-limiting example, the unique magnetic field pattern may lock or unlock a physical lock that includes a magnetic sensor that senses or reads magnetic field patterns. A processing device can be used to determine if a magnetic field pattern matches one or more stored magnetic field patterns.

Figure 11:
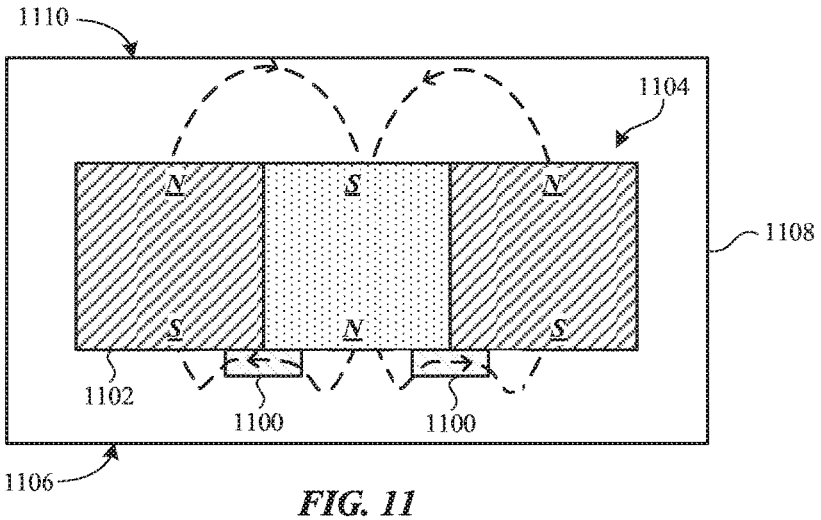
FIG. 11 shows a simplified depiction of a first enclosure that includes a multi-pole magnet assembly.

Discrete shunts may be used to increase or decrease the magnetic attraction force associated with a surface of an enclosure. As shown in FIG. 11, the discrete shunts 1100 over surface 1102 of the multi-pole magnet structure 1104 can decrease the magnetic attraction forces associated with surface 1106 of enclosure 1108. The magnetic attraction forces associated with at least one other surface (e.g., surface 1110) may increase due to a portion of the magnetic field being directed through the magnets and out at least one other surface of the magnets.

Figure 12:
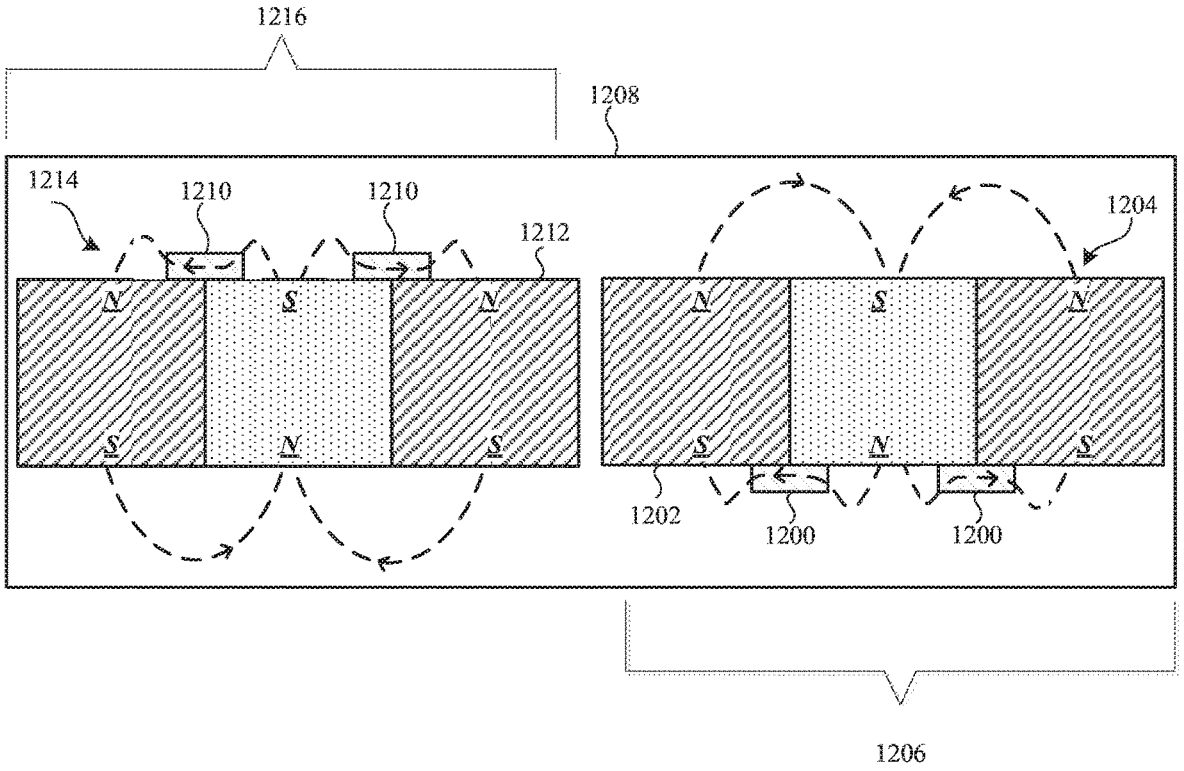
FIG. 12 depicts a simplified illustration of a second enclosure that includes multi-pole magnet assemblies.
Figure 13:
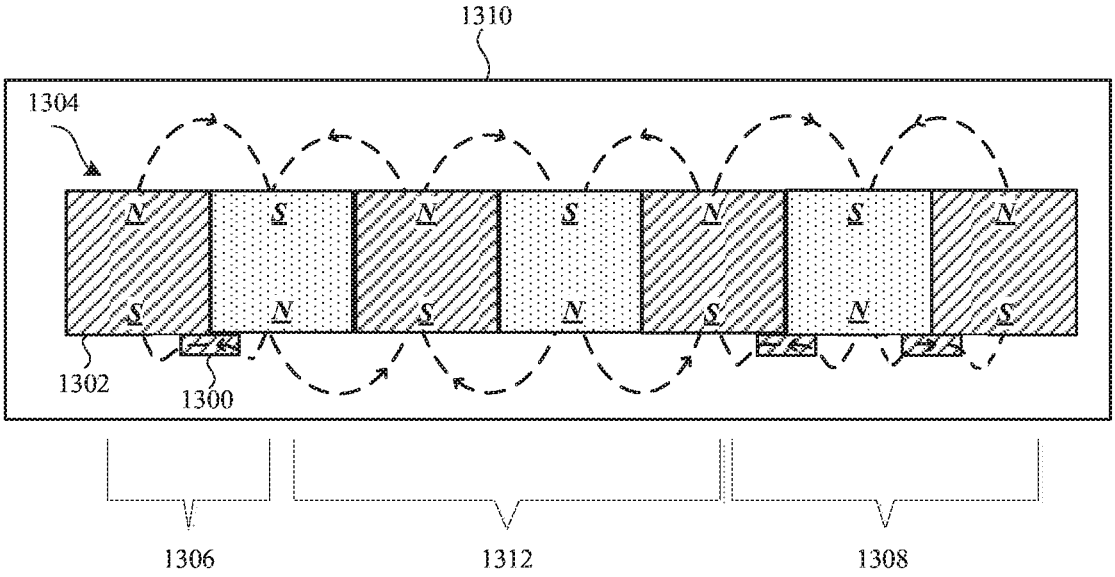
FIG. 13 shows a simplified depiction of a third enclosure that includes a multi-pole magnet assembly.

Additionally, discrete shunts can be used to increase the magnetic attraction force on one region of a surface of an enclosure and to decrease the magnetic attraction force on another region of a different surface of the enclosure. As shown in FIG. 12, discrete shunts 1200 disposed over surface 1202 of multi-pole magnet structure 1204 can decrease the magnetic attraction forces associated with region 1206 of enclosure 1208. Discrete shunts 1210 positioned over surface 1212 of multi-pole magnet structure 1214 can decrease the magnetic attraction forces associated with region 1216 of enclosure 1208.

Discrete shunts may also be used to vary the magnetic attraction forces over a single surface of an enclosure. Discrete shunts 1300 are positioned over different locations of surface 1302 of multi-pole magnet structure 1304 (see, FIG. 13). The magnetic attraction forces are reduced at regions 1306 and 1308 of enclosure 1310. The magnetic attraction forces are not reduced at region 1312 of enclosure 1310. Thus, as described in conjunction with FIG. 5, discrete shunts may be disposed over the surface of multi-pole magnet structure of enlarged second magnet 408A adjacent bottom layer 202 to reduce the magnetic attraction force associated with bottom layer 202. Additionally, shunts may be positioned over a surface or surfaces of one or more remaining second magnets 408 and/or one or more first magnets 406 adjacent bottom layer 202 to dampen the magnetic attraction forces associated with bottom layer 202.

Figure 14:
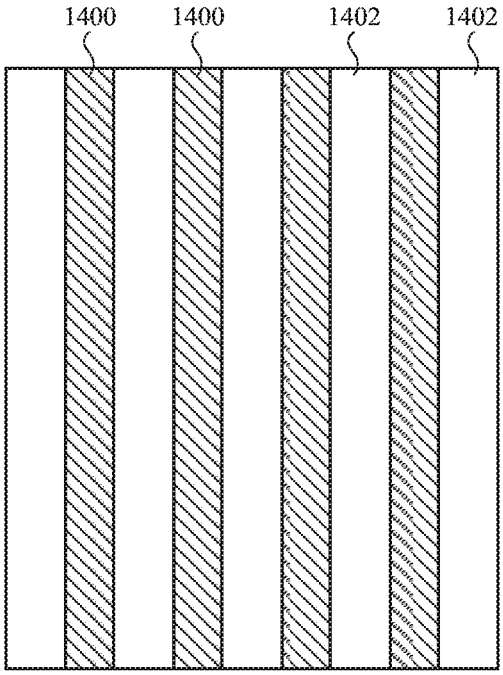
FIG. 14 depicts a plan view of a first example of a magnetic shunt assembly.

Referring now to FIG. 14, there is shown a plan view of one example of a magnetic shunt assembly. As shown in FIG. 14, strips of ferromagnetic material 1400 alternate between strips of non-ferromagnetic material 1402. In a non-limiting example, the ferromagnetic material 1400 may be magnetic stainless steel and the non-ferromagnetic material 1402 can be non-magnetic stainless steel. Strips 1400 can be attached to strips 1402 to form a continuous layer of a magnetic shunt assembly. Any suitable attachment mechanism may be used to affix the strips to one another. For example, strips 1400, 1402 can be welded together to form the continuous layer. The continuous layer of the magnetic shunt assembly may be positioned over and affixed to a surface of a multi-pole magnet assembly. Any suitable attachment mechanism can be used to affix the shunt assembly to the surface of the multi-pole magnet assembly. As one example, an adhesive can be used to attach the shunt assembly to the surface of the multi-pole magnet assembly.

It is understood that the number, shape, size, material, and/or arrangement of the strips shown in FIG. 14 may be merely exemplary. That is, the number of strips, the shape, size, material, and/or arrangement of the strips may be merely exemplary for clearly and completely describing the disclosure, and may not represent the actual number, shape, size, material, and/or arrangement of the strips used to form wearable band 108 for wearable electronic device 100 (see, FIG. 1).

Figure 15A:
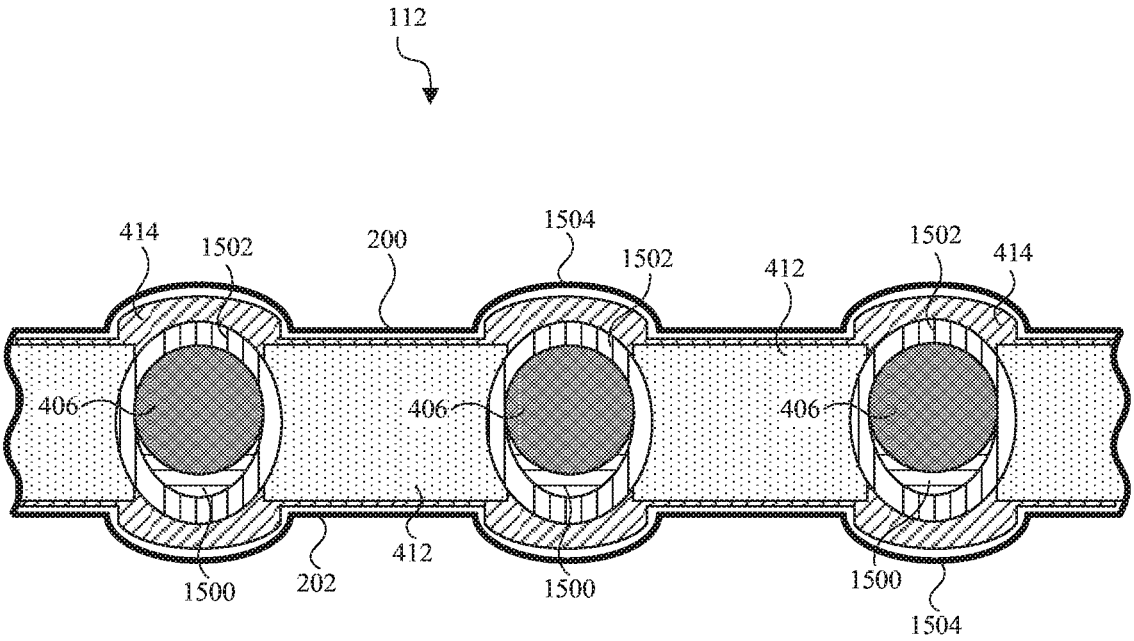
FIG. 15A shows a cross-section side view of the strap of the wearable band taken along line 15A-15A in FIG. 4.
Figure 15B:
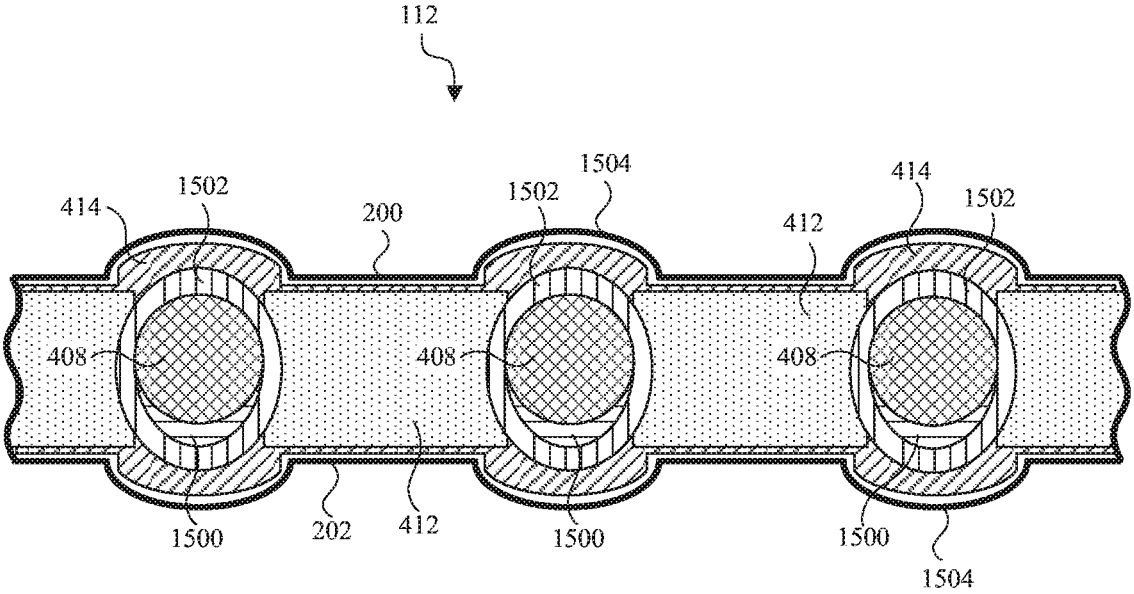
FIG. 15B depicts a cross-section side view of the strap of the wearable band taken along line 15B-15B in FIG. 4.

FIGS. 15A and 15B show cross-section side views of distinct portions of second strap portion 112 of wearable band 108. Specifically, FIG. 15A shows a cross-section side view of second strap portion 112 taken along line 15A-15A of FIG. 4, and depicts first magnets 406 of first group of components 400 positioned between top layer 200 and bottom layer 202 of second strap portion 112. Additionally, FIG. 15B shows a cross-section side view of second strap portion 112 taken along line 15B-15B of FIG. 4, and depicts second magnets 408 of second group of components 402 positioned between top layer 200 and bottom layer 202 of second strap portion 112. It is understood that similarly named components or similarly numbered components may function in a substantially similar fashion, may include similar materials and/or may include similar interactions with other components. Redundant explanation of these components has been omitted for clarity.

As shown in FIGS. 15A and 15B, second strap portion 112 may also include a shunt 1500. More specifically, a plurality of shunts 1500 may be coupled to or substantially cover or surround a portion of each first magnet 406 (see, FIG. 15A) and each second magnet 408 (see, FIG. 15B). The portion of each first magnet 406 and second magnet 408 covered by shunt 1500 may be a bottom portion of each magnet 406, 408 positioned adjacent bottom layer 202 of second strap portion 112. That is, as shown in FIGS. 15A and 15B, shunt 1500 may cover a portion of first magnets 406 and second magnets 408, respectively, positioned directly adjacent bottom layer 202. A top portion of magnets 406, 408, opposite the bottom portion covered by shunt 1500, may remain substantially uncovered to aid in the magnetic coupling of magnets 406, 408 and/or inserts 404 during use of wearable electronic device 100, as discussed herein. As noted above, shunt 1500 of second strap portion 112 may substantially block, redirect or minimize a magnetic flux in a portion of the magnets 406, 408 covered by shunt 1500.

As described above, the magnets 406, 408 may configured as a multi-pole magnet structure, and distinct magnets (or portions of the multi-pole magnet structure that correspond to a particular magnetic pole) may be associated with distinct shunts. In some embodiments, shunt 1500 is part of a magnetic shunt assembly that corresponds to a particular multi-pole magnet assembly and includes distinct shunts (and/or non-shunting components, described below) to correspond to particular portions of the multi-pole magnet structure. Shunt assemblies with distinct shunts and/or shunt portions are shown and discussed with respect to FIGS. 15C-15D. Alternatively, shunt 1500 may be a single component that covers a portion of each magnet or portion of a multi-pole magnet structure (not shown). In other words, instead of a shunt that has multiple distinct shunts and/or shunt portions each corresponding to a discrete magnet, the shunt 1500 may be a single component that is long enough to cover the desired portion of an entire magnet structure.

Figure 15C:
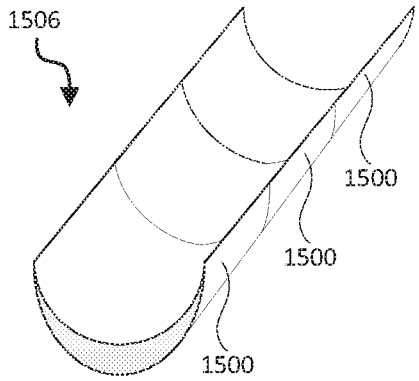
FIG. 15C depicts a perspective view of a second example of a magnetic shunt assembly.
Figure 15D:
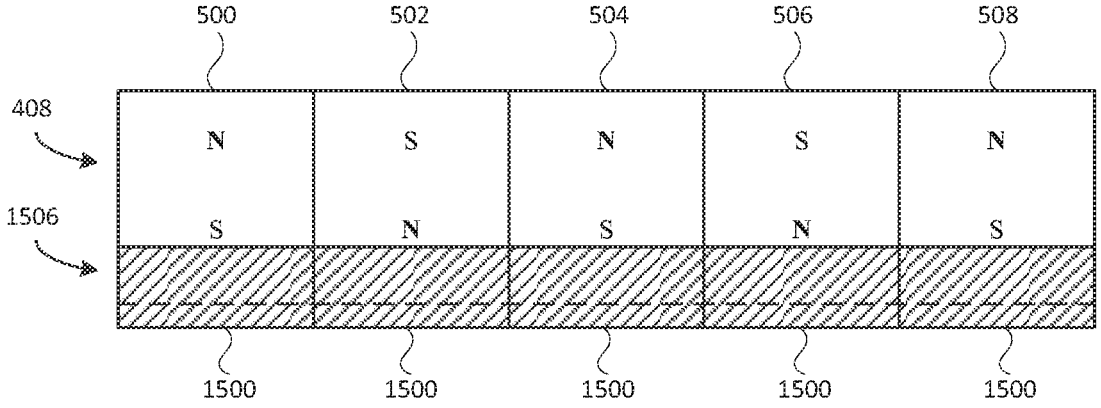
FIG. 15D depicts a cross-section end view of a fifth multi-pole magnet assembly taken along line 15D-15D in FIG. 4.
Figure 15E:
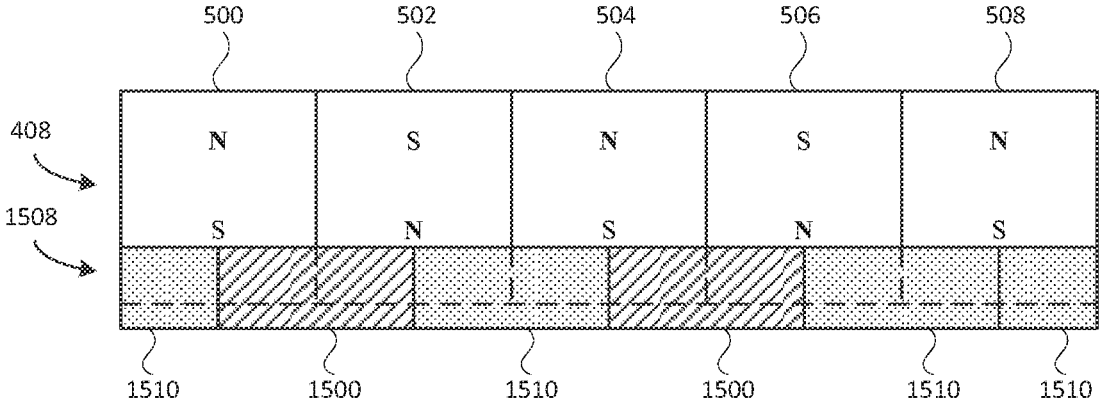
FIG. 15E depicts a cross-section end view of a sixth multi-pole magnet assembly taken along line 15D-15D in FIG. 4.

FIG. 15C shows a simplified perspective view of a magnetic shunt assembly 1506 including shunts 1500. While three shunts 1500 are shown in FIG. 15C, more or fewer shunts 1500 may be used. FIG. 15D shows a simplified cross-section of magnet 408 taken along line 15D-15D of FIG. 4, and depicts magnet 408 (composed of second magnets 500, 502, 504, 506, and 508) coupled to one example of a magnetic shunt assembly (magnetic shunt assembly 1506). Magnetic shunt assembly 1506 includes a plurality of shunts 1500. Shunts 1500 may be positioned adjacent a magnet and/or adjacent a transition area between the magnets of the multi-pole magnet structure. FIG. 15D illustrates individual shunts 1500 each adjacent a respective second magnet of magnet 408 FIG. 15E shows a simplified cross-section of magnet 408 taken along line 15D-15D of FIG. 4, and depicts magnet 408 coupled another example of a magnetic shunt assembly (magnetic shunt assembly 1508), where shunts 1500 are adjacent transition areas between the respective second magnets of magnet 408.

In some embodiments, a magnetic shunt assembly (e.g., magnetic shunt assembly 1506, 1508) includes one or more non-shunting components 1510 positioned between shunts 1500. Non-shunting components 1510 may be used to separate shunts 1500 from one another so as to allow selective shunting of the magnetic fields of individual magnets in a multi-pole magnet structure (e.g., to generate unique and identifiable arrangement of magnetic fields, as described above with respect to FIG. 13). For example, non-shunting components 1510 may be used to fill gaps between individual shunts 1500 while still forming a continuous structure, as shown in FIG. 15D. In some embodiments, magnetic shunt assembly 1508 may be composed entirely of shunts 1500 without interstitial non-shunting components 1510.

Using a continuous structure for the magnetic shunt assembly even when shunts are not needed or desirable at every transition area may improve manufacturability of the second strap portion 112 by reducing the number of discrete parts that need to be aligned and/or assembled when manufacturing the second strap portion 112, and may improve aesthetics by eliminating irregularities, bumps, or asymmetries that may otherwise occur if shunts were not placed continuously along a multi-pole magnet structure.

Shunts 1500 and non-shunting components 1510 (if any) in magnetic shunt assembly 1506, 1508 may be coupled using any suitable coupling component and/or technique (e.g., thread, adhesive, melting and so on). Alternatively, shunts 1500 and non-shunting components 1510 (if any) in magnetic shunt assembly 1506, 1508 may be held together by an encapsulating material, such as an overmolded resin coating. Second strap portion 112 of wearable band 108 may also include a resin outer coating 1502. More specifically, as shown in FIGS. 15A and 15B, resin outer coating 1502 may be formed around each of first magnets 406 and shunt 1500 (see, FIG. 15A), and second magnets 408 and shunt 1500 (see, FIG. 15B). (As used herein, shunt 1500 may be a discrete shunt or a magnetic shunt assembly containing multiple discrete shunts and/or non-shunting connecting plates.) Resin outer coating 1502 may form a barrier around magnets 406, 408 and shunt 1500, and may separate magnets 406, 408 and shunt 1500 from distinct components (e.g., protective layer 412, filler material 414) positioned between top layer 200 and bottom layer 202 of second strap portion 112. Resin outer coating 1502 may be formed using any suitable casting technique or process, and may be formed around the respective magnets 406, 408 and shunt 1500 after shunts 1500 are coupled to the magnets 406, 408 to encompass both components. Additionally, resin outer coating 1502 may be formed from any suitable resin material that may be formed around magnets 406, 408 and shunt 1500 to maintain the coupling between magnets 406, 408 and shunt 1500, and/or provide structure to magnets 406, 408 and shunt 1500 within second strap portion 112.

As shown in FIGS. 15A and 15B, top layer 200 and bottom layer 202 may include protrusions 1504 positioned substantially adjacent magnets 406, 408. More specifically, the portions of top layer 200 and bottom layer 202 positioned directly above and/or below magnets 406, 408 may include protrusions 1504, extending above the remaining portions of top layer 200 and bottom layer 202. Protrusions 1504 may be formed in top layer 200 and bottom layer 202 as a result of the dimension of magnets 406, 408, shunts 1500 and/or resin outer coating 1502, as well as, the hardness of each of the components (e.g., magnets 406, 408, shunts 1500 and so on) positioned between protrusions 1504. That is, because magnets 406, 408 and/or shunts 1500 are formed from materials that are not substantially deformable, and/or because magnets 406, 408, shunts 1500 and/or resin outer coating 1502 may be substantially larger than protective layer 412, protrusions 1504 may be formed in top layer 200 and bottom layer 202 of second strap portion 112. However, protrusions 1504 may be substantially minimal and may not be visible to a user of wearable band 108. That is, protrusions 1504, although extending above the remaining portions of top layer 200 and below bottom layer 202 of second strap portion 112, may only extend above/below a negligible amount, such that a user of wearable band 108 including second strap portion 112 may view top layer 200 and bottom layer 202 as substantially planar surfaces. As discussed herein, protrusions 1504 formed on top layer 200 and bottom layer 202 may aid in the aligning and/or magnetic coupling of second strap portion 112 when wearable electronic device 100 is coupled to a user using wearable band 108.

Turning to FIGS. 16-19, a description of how wearable band 108 functions to couple wearable electronic device 100 (see, FIG. 1) to a user may now be discussed. Specifically, FIGS. 16-19 may illustrate how a portion of second band 112 is positioned through loop 208 or 300 of first band 110 and folded back onto itself, such that second magnets 408 of second group of components 402 may be coupled to first magnets 406 of first group of components 400 and/or inserts 404 to secure wearable band 108 around a user.

Figure 16:
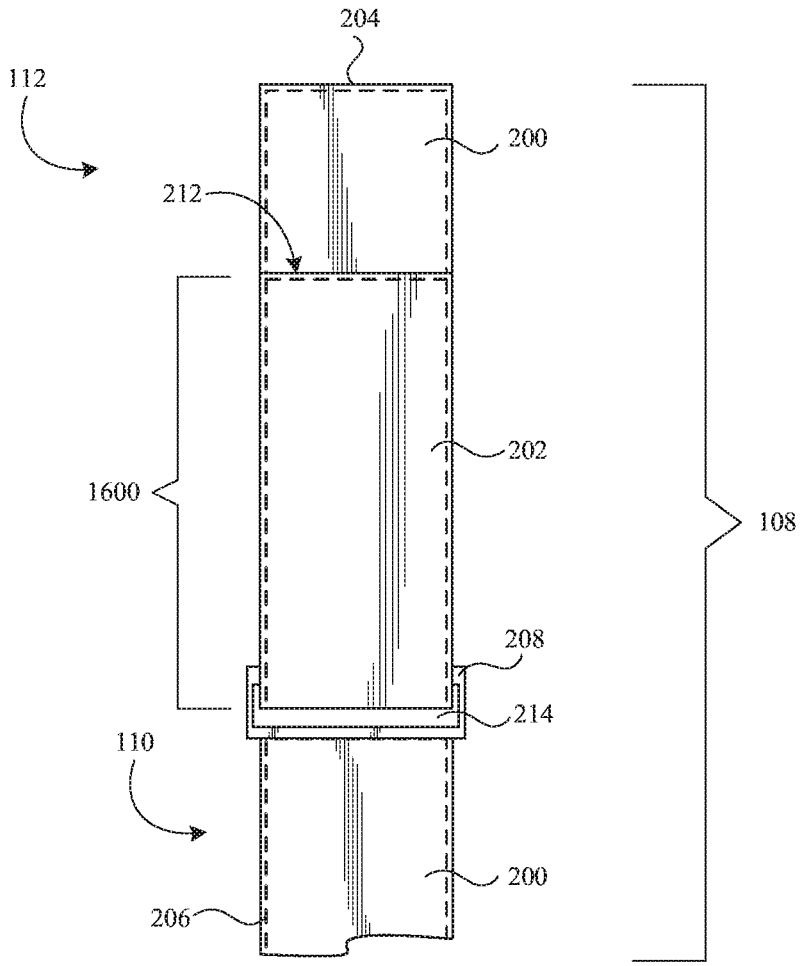
FIG. 16 shows an illustrative top view of the wearable band as shown in FIG. 2 coupled to the loop.

FIG. 16 shows a top view of wearable band 108 of wearable electronic device 100 (see, FIG. 1) including second strap portion 112 coupled to first strap portion 110. More specifically, free end 212 of second strap portion 112 may be positioned or fed through opening 214 of loop 208 coupled to first strap portion 110, and may be subsequently pulled toward housing end 204 of second strap portion 112 to couple second strap portion 112 to first strap portion 110. As shown in FIG. 16, and as discussed herein, as a result of folding a portion 1600 of second strap portion 112 back onto itself to couple second strap portion 112 to first strap portion 110, bottom layer 202 of the folded portion 1600 may be exposed and/or facing away from a contact surface (e.g., user's skin) in which the wearable band 108 is coupled.

Figure 17:
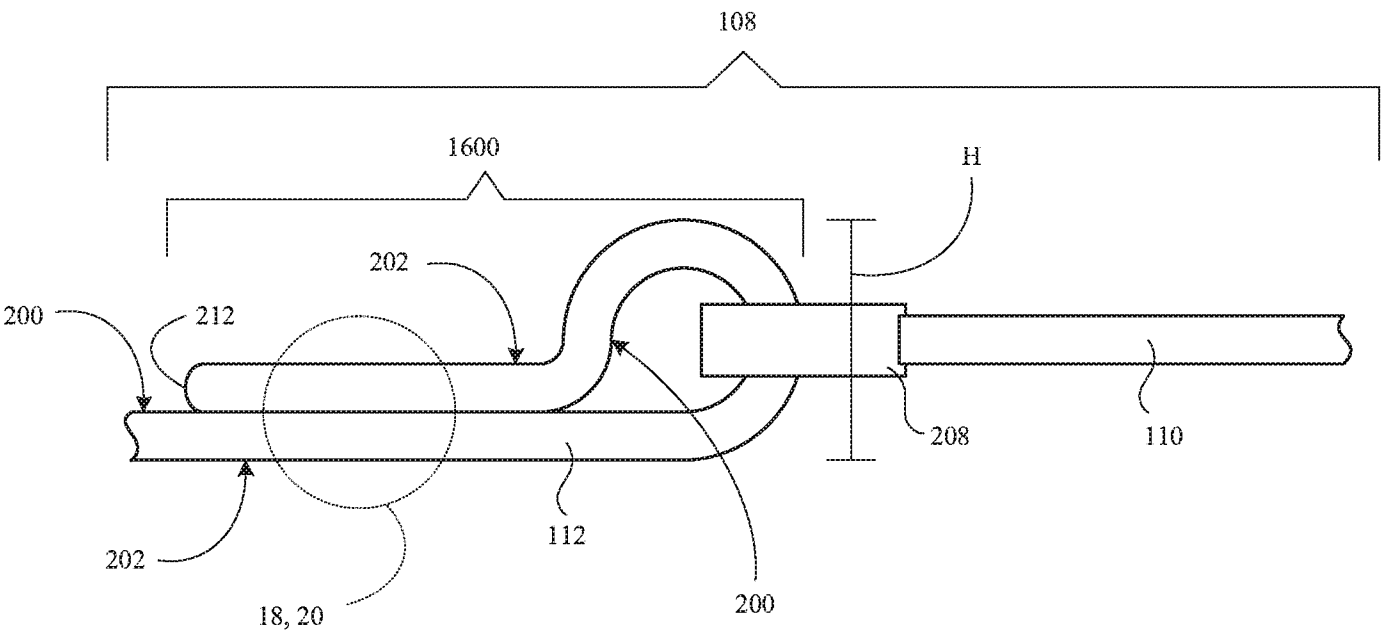
FIG. 17 depicts an illustrative side view of a portion of the wearable band as shown in FIG. 16 coupled to the loop.

FIG. 17 depicts a side view of a portion of wearable band including second strap portion 112 coupled to first strap portion 110. That is, FIG. 17 illustrates second strap portion 112 positioned or feed through opening 214 of loop 208 coupled to first strap portion 110, and subsequently pulled toward housing end 204 (see, FIG. 16) of second strap portion 112 to couple second strap portion 112 to first strap portion 110. As shown in FIG. 17, folded portion 1600 of second strap portion 112 positioned through and/or adjacent loop 208 of first strap portion 110 may include a substantial curve in the material forming second strap portion 112 to fold folded portion 1600 back onto the remaining portion of second strap portion 112. The folded portion 1600 may include this curve, and ultimately may include a minimal height (H) difference within folded portion 1600, as a result of magnets 406, 408 being separated and/or spaced apart. That is, folded portion 1600 may be closely folded around loop 208 of first strap portion 110, such that the height (H) of the fold is substantially small, as a result of magnets 406, 408 being spaced apart and/or separated by the flexible material forming protective layer 412. When spaced apart, magnets 406, 408 may not substantially obstruct or limit the flexibility of second strap portion 112 by contacting each other during the folding of folded portion 1600 around loop 208. The height (H) of folded portion 1600 may be substantially small or negligible to avoid the undesirable catching of folding portion 1600 on another object, and ultimately the uncoupling of folded portion 1600 from the remaining portion of second strap portion 112.

Figure 18:
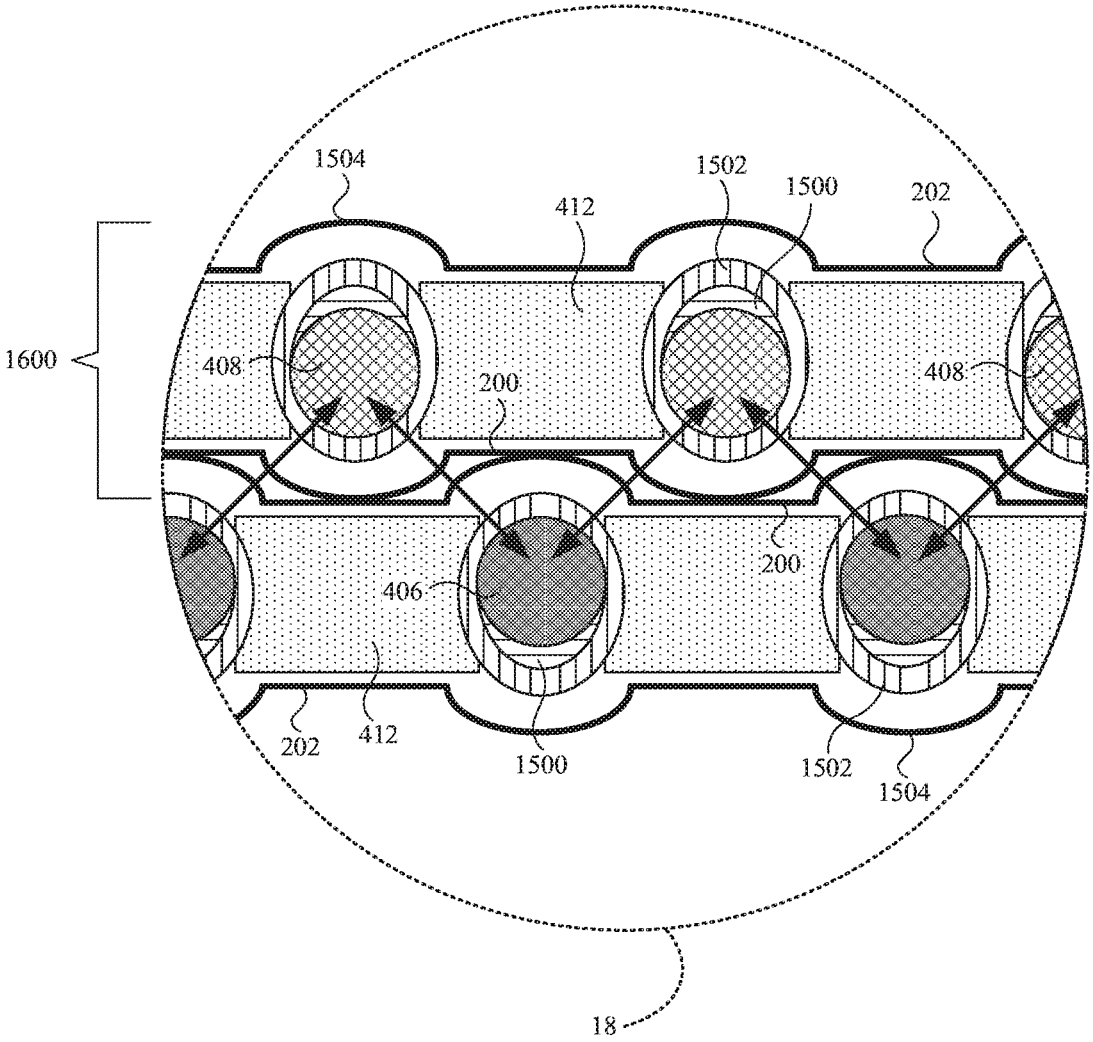
FIG. 18 shows an enlarged portion of a second strap portion of the wearable band as shown in FIG. 17 coupled to the loop.

FIG. 18 shows an enlarged cross-section side view of a portion of second strap portion 112 in FIG. 17. Specifically, FIG. 18 shows a portion of folded portion 1600 including second magnets 408 coupled to the remaining portion of second strap portion 112 including first magnets 406. When folded portion 1600 contacts the remaining portion of second strap portion 112, the respective magnets, 406, 408 may be magnetically attracted to, and/or coupled to one another. That is, and as shown in FIG. 18, second magnets 408 included in folded portion 1600 may be positioned adjacent and/or above first magnets 406 of second strap portion 112, and may be magnetically coupled to surrounding first magnets 406. The magnetic attraction between first magnet 406 and second magnet 408 may be illustrated within FIG. 18 using reference arrows. As shown in FIG. 18, and discussed in detail herein, the polarity configuration of magnets 406, 408 may result in second magnets 406 being aligned between and magnetically coupled to two distinct first magnets 408. As a result, magnets 406 may be aligned in a staggered configuration as shown in FIG. 18.

Additionally as shown in FIG. 18, protrusions 1504 formed on top layer 200 and bottom layer 202 of second strap portion 112 may aid in the staggered alignment of first magnets 406 and second magnets 408. More specifically, protrusions 1504 of folded portion 1600 may be positioned between protrusions 1504 formed in the remaining portion of second strap portion 112 to align first magnets 406 with second magnets 408 in a staggered configuration. As discussed herein, the staggering of first magnets 406 and second magnets 408 may provide for a strong bond or magnetic coupling between folded portion 1600 and the remaining portion of second strap portion 112.

As shown in FIG. 18, and discussed herein, protrusion 1504 formed on top layer 200 of folder portion 1600 of second strap portion 112 may be positioned adjacent protrusions 1504 formed on top layer 200 of the remaining portion of second strap portion 112. Additionally, bottom layer 202 in folded portion 1600 and bottom layer 202 of the remaining portion of second strap portion 112 may be positioned opposite one another and/or exposed. As a result, and as shown in FIG. 18, shunts 1500 may also be positioned adjacent the exposed bottom layer 202. As discussed herein, shunts 1500 may be positioned adjacent the exposed bottom layer 202 when folded portion 1600 is coupled to the remaining portion of second strap portion 112 to prevent wearable band 108 from being undesirably attracted or magnetically coupled to foreign objects or to adversely interfere with foreign objects.

In embodiments that position discrete shunts over the surface of one or more second magnets 408, and over the surface of one or more first magnets 406 adjacent bottom layer 202, the discrete shunts may be positioned adjacent the exposed bottom layer 202 when folded portion 1600 is coupled to the remaining portion of second strap portion 112 to prevent wearable band 108 from being undesirably attracted or magnetically coupled to foreign objects or to adversely interfere with foreign objects.

Figure 19:
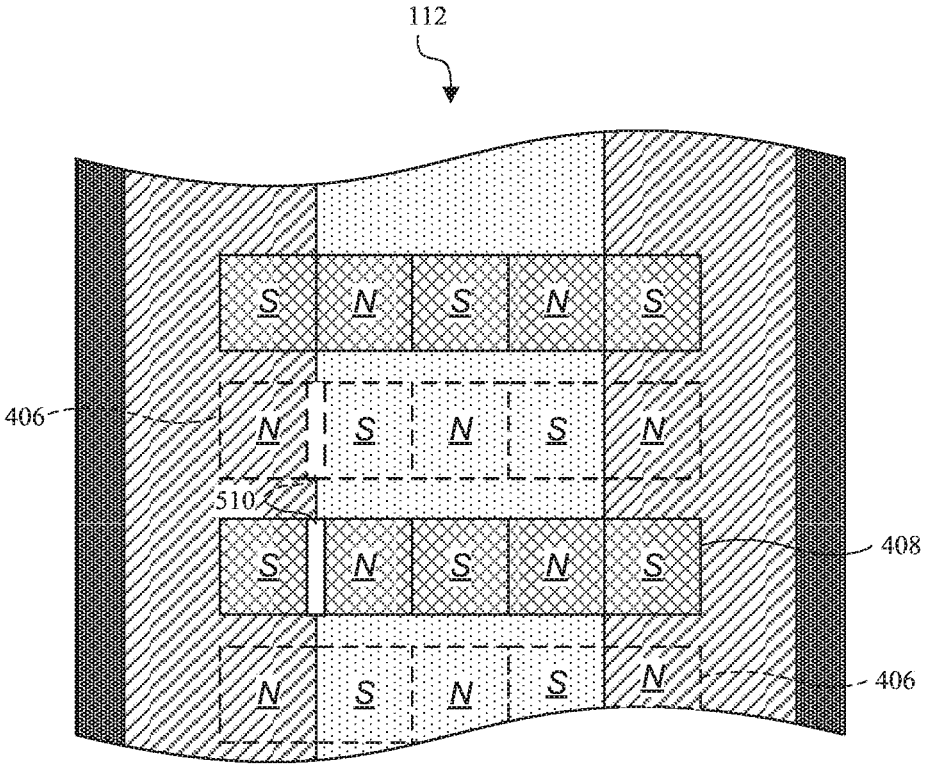
FIG. 19 depicts an enlarged cross-section top view of a second strap portion of the wearable band as shown in FIGS. 16-18 coupled to the loop.

FIG. 19 shows an enlarged top view of a portion of second strap portion 112 after free end 212 is fold over and positioned on the remaining portion of second strap portion 112. Bottom layer 202 of second strap portion 112 is removed in FIG. 19 to clearly show the alignment of first magnets 406 (shown in phantom), and second magnets 408 in folded portion 1600 of second strap 112. As shown in FIG. 19, first magnets 406 and second magnets 408 may be magnetized and/or include various alternating magnetic fields or polarities (e.g., north (N), south (S)) over the length of the magnet. More specifically, first magnets 406 may include a first configuration of alternating magnetic fields over the length of the magnet, and second magnets 408 may include a second configuration of alternating magnetic fields over the length of the magnet, distinct from the first configuration of first magnets 406. As shown in FIG. 19, each of the individual magnetic fields of the second configuration of alternating magnetic fields for second magnets 408 may include a magnetic polarity opposite to a corresponding individual magnet field of the first configuration of alternating magnetic fields for first magnets 406.

The configuration of magnetic fields for first magnets 406 and second magnets 408 may be opposite one another to form a magnetic attraction or magnetic bond between the respective magnets, as discussed herein. That is, each individual portion of second magnet 408 including a polarity may be magnetically attracted to and/or magnetically bonded to a corresponding portion of first magnet 406 including an opposite polarity. Additionally, as a result of spacing the magnets within second strap portion 112, each second magnet 408 may be positioned between and may be magnetically attracted to and/or magnetically bonded to two first magnets 406 positioned on either side of second magnet 408. This may ultimately result in a strong bond between folded portion 1600 of second strap portion 112 and the remaining portion of second strap portion 112 when wearable band 108 is coupled to a user's wrist. Finally, the first and second configurations of the magnetic fields for each of first magnets 406 and second magnets 408 may allow folded portion 1600 of second strap portion 112 to be aligned with the remaining portion of second strap portion 112 during magnetic bonding or coupling. More specifically, and as shown in FIG. 19, because both first magnets 406 and second magnets 408 include a plurality of alternating, and opposite, magnetic fields throughout the entire length of the respective magnet, second magnets 408 may be aligned with, and magnetically bonded to first magnets 406 in such a way that all portions are magnetically bonded or attracted. As such, where both first magnets 406 and second magnets 408 are positioned in aligned within second strap section 112, when magnetically bonded, the magnetic field configurations of first magnets 406 and second magnets 408 may not only align the respective magnets, but may also align the edges of folded portion 1600 and the remaining portion of second strap portion 112 when wearable band 108 is coupled to a user.

In embodiments that include discrete shunts, the discrete shunts may be positioned adjacent bottom layer 202. For simplicity, FIG. 19 shows one discrete shunt 510 over one second magnet 408 and one discrete shunt 510 (shown in phantom) over one first magnet 406.

Figure 20:
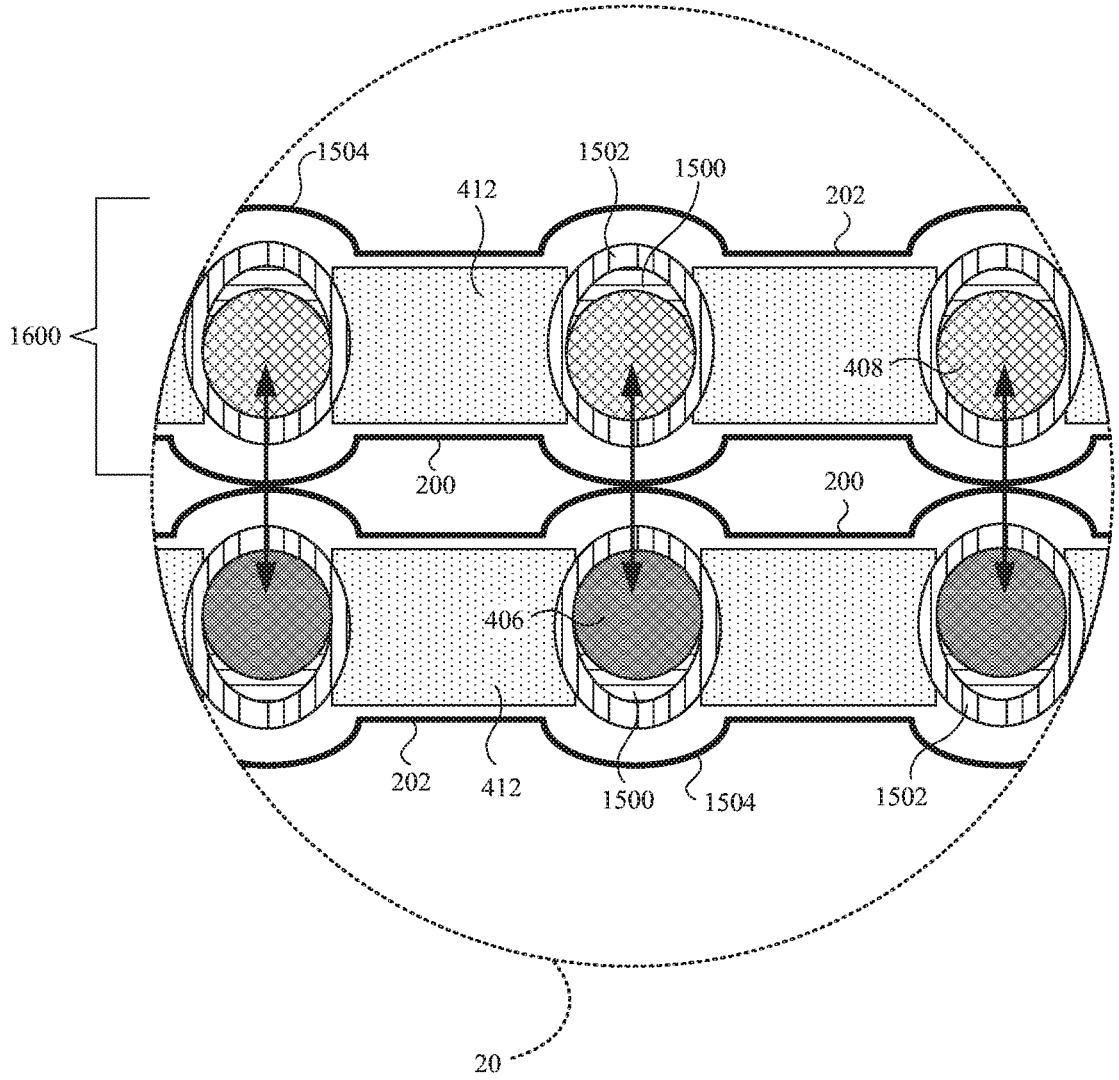
FIG. 20 shows an enlarged portion of a second strap portion of the wearable band as shown in FIG. 17.

In an additional non-limiting example, protrusions 1504 of top layer 200 and bottom layer 202 of the respective strap portions may be substantially aligned and contacting when utilizing wearable band 108. FIG. 20 shows an enlarged cross-section side view of a portion of second strap portion 112 in FIG. 17, according to another embodiment. Specifically, FIG. 20 shows a portion of folded portion 1600 including second magnets 408 coupled to the remaining portion of second strap portion 112 including first magnets 406. Like FIG. 18, the respective magnets 406, 408 may be magnetically attracted to, and/or coupled to one another, as illustrated in FIG. 20 using reference arrows. Distinct from FIG. 18, protrusions 1504 of second strap portion 112 may be in substantial alignment and/or may contact each other when folded portion 1600 of second strap portion 112 is magnetically coupled to the remaining portion of second strap portion 112. That is, the polarity configuration of magnets 406, 408 may result in first magnets 406 being aligned directly above and magnetically coupled to a single, corresponding second magnet 408. As a result, and compared to FIG. 18, each of the first magnets 406 may be aligned in a common vertical plane as a corresponding second magnet 408 as shown in FIG. 20. Additionally, and as discussed herein, each protrusion 1504 of folded portion 1600 may also be aligned in a common vertical plane with a corresponding protrusion 1504 in the remaining portion, and no protrusions 1504 included in the folded portion 1600 may be positioned between two distinct protrusions 1504 of the remaining portion of second strap portion 112. As discussed herein, a common vertical plane may be understood as a vertical plane passing through a top and bottom magnet and/or protrusion with respect to the orientation and positioning shown in FIG. 20.

As shown in FIG. 20, and discussed herein, protrusion 1504 formed on top layer 200 of folded portion 1600 of second strap portion 112 may be positioned adjacent, and substantially aligned with, corresponding protrusions 1504 formed on top layer 200 of the remaining portion of second strap portion 112. Additionally, bottom layer 202 in folded portion 1600 and bottom layer 202 of the remaining portion of second strap portion 112 may be positioned opposite one another and/or exposed. As a result, and as shown in FIG. 20, shunts 1500 may also be positioned adjacent the exposed bottom layer 202. As discussed herein, shunts 1500 may be positioned adjacent the exposed bottom layer 202 when folded portion 1600 is coupled to the remaining portion of second strap portion 112.

In embodiments that position discrete shunts over the surface of one or more second magnets 408, and over the surface of one or more first magnets 406 adjacent bottom layer 202, the discrete shunts may be positioned adjacent the exposed bottom layer 202 when folded portion 1600 is coupled to the remaining portion of second strap portion 112 to prevent wearable band 108.

As similarly discussed herein with respect to FIG. 19, first magnets 406 and second magnets 408 may be magnetized and/or include various alternating magnetic fields or polarities (e.g., north (N), south (S)) over the length of the magnet. More specifically, first magnets 406 may include a first configuration of alternating magnetic fields over the length of the magnet, and second magnets 408 may include a second configuration of alternating magnetic fields over the length of the magnet, distinct from the first configuration of first magnets 406. Each of the individual magnetic fields of the second configuration of alternating magnetic fields for second magnets 408 may include a magnetic polarity opposite to a corresponding individual magnet field of the first configuration of alternating magnetic fields for first magnets 406.

The configuration of magnetic fields for first magnets 406 and second magnets 408 may be opposite one another to form a magnetic attraction or magnetic bond between the respective magnets, as discussed herein. That is, each individual portion of second magnet 408 including a polarity may be magnetically attracted to and/or magnetically bonded to a corresponding portion of first magnet 406 including an opposite polarity. Additionally, as a result of the configuration of the magnets within second strap portion 112, each second magnet 408 may be aligned in a common plane and may be magnetically attracted to and/or magnetically bonded to a single, corresponding first magnet 406 directly below second magnet 408.

Although not shown in FIG. 20, it is understood that the magnetic attraction and/or coupling of between the folded portion 1600 and the remaining portion of second strap portion 112 may cause at least a partial deformation in wearable band 108. More specifically, as a result of the flexible and/or elastic material used to form at least a portion of second strap portion 112, aligned, and contacting protrusions 1504 of second strap portion 112 may be deformed, such that second strap portion 112 is substantially flat or linear. The deformation of protrusions 1504 may be based on the magnetic attraction and/or magnetic coupling formed between the magnets 406, 408 of wearable band 108.

Figure 21:
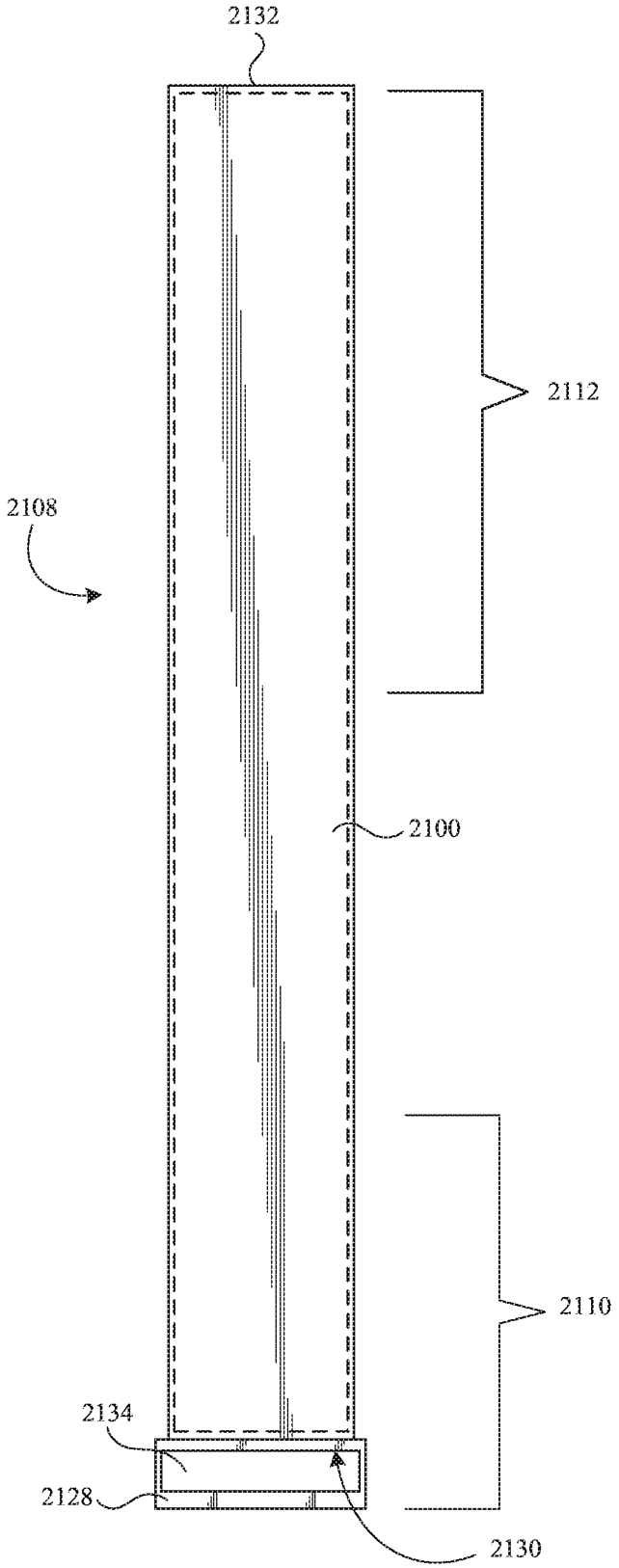
FIG. 21 depicts an illustrative top view of another wearable band.

Although shown herein as including two distinct straps (e.g., first strap portion 110, second strap portion 112), wearable band may be formed from a single strap. More specifically, and as shown in FIG. 21, wearable band 2108 may be formed as a single strap, such that first strap portion 2110 and second strap portion 2112 may be integrally formed. It is understood that similarly named components or similarly numbered components may function in a substantially similar fashion, may include similar materials and/or may include similar interactions with other components. Redundant explanation of these components has been omitted for clarity.

As discussed herein, wearable band 2108 may be formed from a single piece of material. That is, wearable band 2108 may be formed from a single piece of material (e.g., leather), where top layer 2100 is folded over and positioned above a bottom layer (not shown) to form wearable band 2108. Where wearable band 2108 is formed from a single piece of material, the fold in the material to differentiate between top layer 2100 and the bottom layer may be positioned at end 2130, adjacent loop 2128. The single piece of material forming wearable band 2108 may be fed through loop 2128 of wearable band 2108, and loop 2128 may be partially positioned between top layer 2100 and the bottom layer, and secured at end 2130 of wearable band 2108. In another non-limiting example, not shown, single strap wearable band 2108 may be formed from two pieces of material, where each piece of material forms a respective layer (e.g., top, bottom) of wearable band 2108.

Wearable band 2108, as shown in FIG. 21, may function substantially similar to wearable band 108 discussed herein with respect to FIGS. 1-20. That is, wearable band 2108 may include free end 2132 positioned opposite, and capable of being positioned through opening 2134 in loop 2128 to be folded back onto a remaining portion of wearable band 2108 to couple wearable electronic device 100 (see, FIG. 1) including wearable band 2108 to a user. Although not shown, it is understood that second strap portion 2112 of wearable band 2108 may include a similar internal configuration as second strap portion 112 discussed herein with respect to FIGS. 4-20. That is, wearable band 2108 may also include a first group of components (e.g., first magnets), a second group of components (e.g., second magnets) and a plurality of inserts positioned between the first and second group of components. The first and second group of components and a plurality of inserts may be utilized to couple a folded portion of second strap portion 2112 to a remaining portion of wearable band 2108 to ultimately couple wearable electronic device 100 to a user, as discussed herein with respect to FIGS. 1-20.

Figure 22:
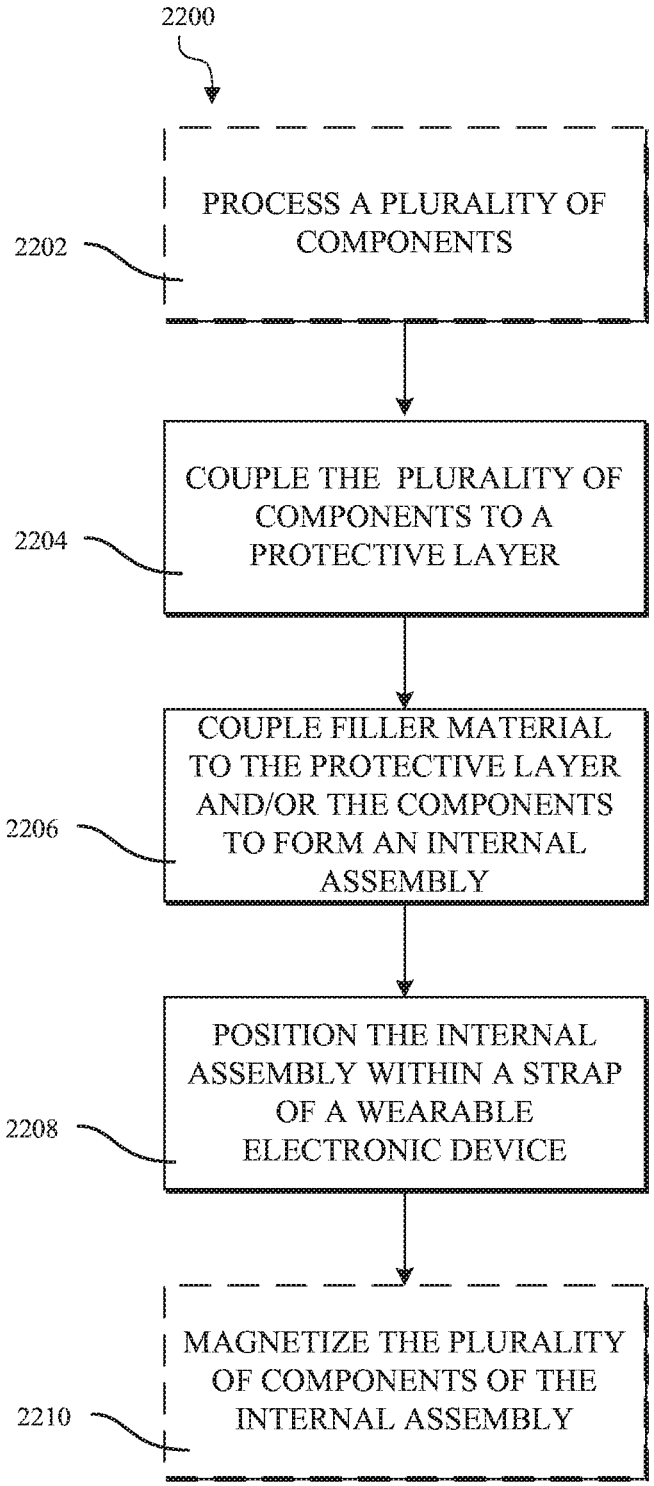
FIG. 22 shows a flowchart illustrating a method of forming a wearable band for an electronic device.

FIG. 22 depicts an example process for forming a wearable band for a wearable electronic device. Specifically, FIG. 22 is a flowchart depicting one example process 2200 for forming a wearable band for a wearable electronic device. In some cases, the process may be used to form one or more wearable bands, as discussed above with respect to FIGS. 1-21.

In a preliminary, optional operation 2202 (shown in phantom) a plurality of components may be processed. More specifically, at least a portion of a plurality of components having magnetic properties may undergo preliminary processes. The processing of at least a portion of the plurality of components may include at least one of coupling a shunt to at least one side of at least the portion of the plurality of components, and/or forming a resin coating around at least the portion of the plurality of components. Additionally, the resin coating formed around the components may also be formed around the shunt, where a shunt is coupled to at least one side of at least the portion of the plurality of components.

In operation 2204, a plurality of components may be coupled to a protective layer. The plurality of components may include magnetic properties. The coupling of the polarity of components may include coupling a first group of magnets to the protective layer, and coupling a second group of magnets to the protective layer opposite the first group of magnets. The first and second group of magnets may or may not be magnetized when coupled to the protective layer. The coupling of operation 2204 may also include coupling a plurality of inserts to the protective layer between the first group of magnets and the second group of magnets. Like the first and second group of magnets, the plurality of inserts may include magnetic properties (e.g., magnetic field, magnetic attraction, and so on). Additionally, the coupling of the plurality of components to the protective layer may also include positioning at least a portion of the protective layer between each of the components (e.g., first and second group of magnets, inserts). That is, each of the first group of magnets, second group of magnets and plurality of inserts may be spaced apart from one another, and/or may be separated by a portion of the protective layer.

In operation 2206, a filler material may be coupled to at least one of the protective layer and/or plurality of components. More specifically, a filler material may be coupled to at least one of the first group of magnets, the second group of magnets, the plurality of inserts and/or the protective layer. Filler material may be coupled to the respective components (e.g., magnets, inserts, protective layer) to form substantially a perimeter around the components. The coupling of the filler material to the protective layer and/or plurality of components may also result in the formation of an internal assembly. The internal assembly may include the first group of magnets, the second group of magnets, the plurality of inserts, the protective layer and the filler material.

In operation 2208, the internal assembly may be positioned within a strap of a wearable electronic device. More specifically, the internal assembly, including the first and second group of magnets, the inserts, the protective layer and the filler material, may be positioned and/or secured within a strap of a wearable electronic device. The strap may be formed from a single piece of material, or a plurality of pieces of material. Where the strap is formed from a single piece of material, the positioning of the internal assembly in operation 2208 may further include positioning the internal assembly on an inner surface of a bottom layer of the strap, and subsequently folding a top layer of the strap over the internal assembly and bottom layer.

In operation 2210 (shown in phantom), at least a portion of the plurality of components of the internal assembly may be magnetized. That is, the first group of magnets and second group of magnets, if not magnetized already, may undergo a magnetizing process. The magnetizing of the portion of components included in the internal assembly may include magnetizing the first group of magnets to have a first unique pattern of polarities, and magnetizing the second group of magnets to have a second unique pattern of polarities, distinct and/or opposite from the first unique pattern of polarities of the first group of magnets. The first group and second group of magnets may include distinct and/or opposite polarities so that the second group of magnets may be magnetically coupled to the first group of magnets during use of the wearable band. Additionally, the distinct and/or opposite polarities between the first and second group of magnets may aid in the alignment of the portions of the band including the respective magnets during use of the wearable band. The second group of magnets may also be magnetically coupled to and/or attracted to the plurality of inserts including magnetic properties.

Although not shown, the internal assembly and/or the strap may undergo additional process for forming a wearable band for a wearable electronic device. For example, at least a portion of the strap may be cut. That is, the strap may undergo a cutting process, where at least a portion of the strap is cut. The strap may be cut to alter the length, and/or width of the strap to a specific or desired dimension. Additionally, a free end of the strap that may be folded back onto a portion of the strap to couple to wearable band to a user may also be cut so that the free end visually and/or cosmetically matches the width of the remaining portion of the wearable band. The strap may be cut prior to positioning the internal assembly within the strap, or subsequent to positioning the internal assembly within the strap.

An additional process not shown may include bonding the edges of the strap including the internal assembly. More specifically, subsequent to positioning the internal assembly within the strap, the edges of the top layer and the bottom layer forming the strap may be bonded together to maintain the internal assembly within the strap. The edges may be bonded using any suitable bonding component or technique. In non-limiting examples, the edges of the strap may be bonded using an adhesive or by stitching the top layer to the bottom layer using a thread positioned through the respective layers adjacent the edges of the strap.

Figure 23:
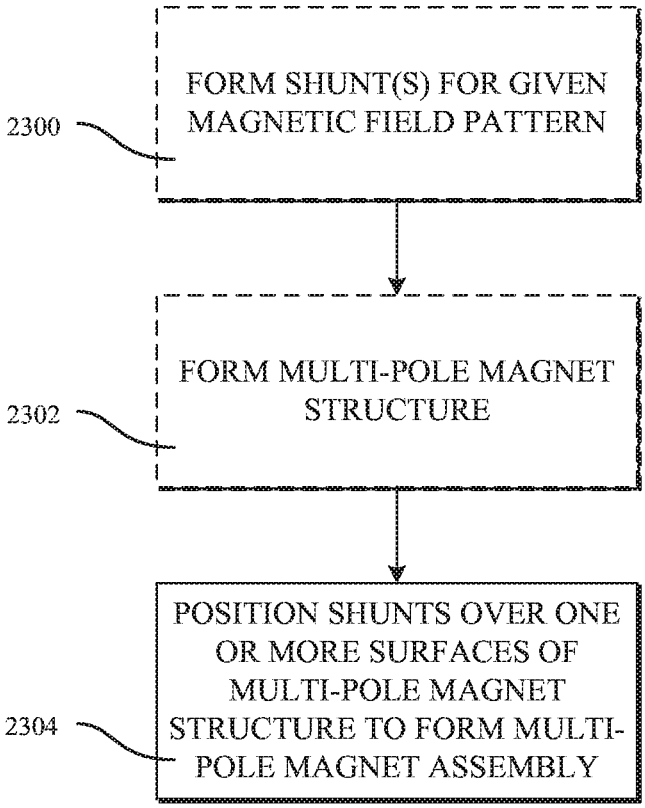
FIG. 23 is a flowchart of a method for producing a multi-pole magnet assembly that may be included in optional operation 2202.

FIG. 23 is a flowchart of a method for producing a multi-pole magnet assembly that may be included in optional operation 2202. In optional operation 2300, one or more shunts may be formed to produce a given magnetic field pattern for a multi-pole magnet structure. As described previously in conjunction with FIG. 14, in one non-limiting example, discrete shunts are formed as strips that alternate with strips of non-ferromagnetic material. The strips of shunts or ferromagnetic material may be affixed to the strips of non-ferromagnetic material to form a layer that is positioned over a multi-pole magnet structure. Additionally, the shunts may be formed into a layer, or the discrete shunts may be positioned individually over respective portions of a multi-pole magnet structure.

In optional operation 2302, one or more multi-pole magnet structures may be formed. The multi-pole magnet structures can be configured as shown in FIG. 6, where the polarities of the magnets alternate across the structure. Other embodiments, however, can construct the multi-pole magnet structure differently. As one example, the multi-pole magnet structure may be a Halbach array.

In operation 2304, the shunt or shunts are positioned over at least one surface of the multi-pole magnet structure to form a multi-pole magnet assembly. The shunt or shunts may be affixed to the multi-pole assembly using any suitable attachment mechanism. As described earlier, an adhesive may be used to attach the shunt(s) to the multi-pole magnet assembly.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not target to be exhaustive or to limit the embodiments to the precise forms disclosed. It will be apparent to one of ordinary skill in the art that many modifications and variations are possible in view of the above teachings.

What is claimed is:

1. A watch band for securing a housing of a watch to a wrist, the watch band comprising:

magnet assemblies, wherein each of the magnet assemblies comprises:

magnets arranged in a row and having an alternating pole arrangement along the row;

a shunt assembly positioned across the magnets in the row; and an outer coating surrounding the magnets and the shunt assembly;

a protective layer having portions separating adjacent pairs of the magnet assemblies; and one or more outer layers surrounding the magnet assemblies and the protective layer.

2. The watch band of claim 1, wherein the magnet assemblies, the protective layer, and the one or more outer layers form a first band portion, wherein the watch band further comprises a second band portion forming a loop, wherein the first band portion is insertable through the loop and the magnet assemblies are arranged to be magnetically coupled to each other when the first band portion is folded onto itself.

3. The watch band of claim 2, wherein the loop is formed of a magnetically attractable metal.

4. The watch band of claim 3, wherein the first band portion further comprises an enlarged magnet that is positioned at a free end of the first hand portion, produces a stronger magnetic field than each of a remainder of the magnet assemblies, and becomes magnetically coupled to the loop when the free end of the first band portion through the loop.

5. The watch band of claim 1, wherein the watch band is foldable onto itself to maintain an alignment of overlapping edges of the one or more outer layers when the magnet assemblies are magnetically coupled to each other in a folded configuration.

6. The watch band of claim 1, wherein the outer coating comprises a resin.

7. The watch band of claim 1, wherein a thickness of the outer coating protrudes beyond a thickness of the protective layer, such that a first thickness of the watch band defined by the one or more outer layers and at the magnet assemblies is greater than a second thickness of the watch hand defined by the one or more outer layers and at the protective layer.

8. The watch band of claim 1, wherein the shunt assembly has a concave surface that surrounds a portion of each of the magnets on a side thereof.

9. A watch band for securing a housing of a watch to a wrist, the watch band comprising:

magnet assemblies, wherein each of the magnet assemblies comprises:

magnets positioned in an alternating pole arrangement; and a shunt assembly overlapping the magnets and having a concave surface that surrounds a portion of each of the magnets on a side thereof;

a first outer layer covering the magnets of the magnet assemblies; and a second outer layer covering each shunt assembly of the magnet assemblies.

10. The watch band of claim 9, wherein the magnet assemblies, the first outer layer, and the second outer layer form a first band portion, wherein the watch band further comprises a second band portion forming a loop, wherein the first band portion is insertable through the loop and the magnet assemblies are arranged to be magnetically coupled to each other when the first band portion is folded onto itself.

11. The watch band of claim 10, wherein the loop is formed of a magnetically attractable metal.

12. The watch band of claim 11, wherein the first band portion further comprises an enlarged magnet that is positioned at a free end of the first band portion, produces a stronger magnetic field than each of a remainder of the magnet assemblies, and becomes magnetically coupled to the loop when the free end of the first band portion through the loop.

13. The watch band of claim 9, wherein the watch band is foldable onto itself to maintain an alignment of overlapping edges of the first and second outer layers when the magnet assemblies are magnetically coupled to each other in a folded configuration.

14. The watch band of claim 9, wherein the shunt assembly has a convex surface opposite the concave surface.

15. A watch band for securing a housing of a watch to a wrist, the watch band comprising:

magnet assemblies, wherein each of the magnet assemblies comprises:

magnets arranged in a row and having an alternating pole arrangement along the row; and a shunt assembly positioned across the magnets in the row, wherein the shunt assembly comprises:

shunts extending across portions of adjacent pairs of the magnets; and non-shunting components positioned between adjacent pairs of the shunts; and one or more outer layers surrounding the magnet assemblies.

16. The watch band of claim 15, wherein the magnet assemblies form a first band portion, wherein the watch band further comprises a second band portion forming a loop, wherein the first band portion is insertable through the loop and the magnet assemblies are arranged to be magnetically coupled to each other when the first band portion is folded onto itself.

17. The watch band of claim 16, wherein the loop is formed of a magnetically attractable metal.

18. The watch band of claim 17, wherein the first band portion further comprises an enlarged magnet that is positioned at a free end of the first hand portion, produces a stronger magnetic field than each of a remainder of the magnet assemblies, and becomes magnetically coupled to the loop when the free end of the first band portion through the loop.

19. The watch band of claim 15, wherein the watch band is foldable onto itself to maintain an alignment of overlapping edges of the one or more outer layers when the magnet assemblies are magnetically coupled to each other in a folded configuration.

20. The watch band of claim 15, wherein the shunt assembly has a concave surface that surrounds a portion of each of the magnets on a side thereof.

* * * * *